US006615492B2

(12) United States Patent
Parsonage et al.

(10) Patent No.: US 6,615,492 B2
(45) Date of Patent: Sep. 9, 2003

(54) DRY SHAVING APPARATUS

(75) Inventors: Ray Parsonage, Maidenhead (GB); Terry Royle, Hampshire (GB); Peter Soul, Reading (GB); Andre Nauber, Frankfurt (DE); Michael Harms, Oberursel (DE); Michael Odemer, Frankfurt (DE)

(73) Assignee: Braun GmbH (DE)

( * ) Notice: Subject to any disclaimer, the term of this patent is extended or adjusted under 35 U.S.C. 154(b) by 0 days.

(21) Appl. No.: 09/961,640

(22) Filed: Sep. 24, 2001

(65) Prior Publication Data

US 2002/0078571 A1 Jun. 27, 2002

Related U.S. Application Data

(62) Division of application No. 09/216,361, filed on Dec. 18, 1998, now Pat. No. 6,308,414, which is a continuation of application No. PCT/EP97/03542, filed on Jul. 4, 1997.

(30) Foreign Application Priority Data

Jul. 5, 1996 (GB) ..... 9614160

(51) Int. Cl.[7] ..... B26B 19/06
(52) U.S. Cl. ..... 30/43.91; 30/93.92
(58) Field of Search ..... 30/34.2, 43.3, 30/43.7, 43.8, 43.9, 43.91, 43.92, 43.6, 43.5, 346.51, 34.1, 43.2

(56) References Cited

U.S. PATENT DOCUMENTS

| | | | |
|---|---|---|---|
| 2,277,328 A | 3/1942 | Kamholz | |
| 2,309,431 A | 1/1943 | Alexay | |
| 2,323,881 A | 7/1943 | Mehl | |
| 2,467,417 A | 4/1949 | Wurtele | |
| 2,584,590 A | 2/1952 | Julian | |
| 2,590,452 A | 3/1952 | Peterson | 30/43.91 |
| 2,675,614 A | 4/1954 | Hatfield | |
| 2,920,387 A | 1/1960 | Marescalchi | |
| 3,156,045 A | 11/1964 | Godefroy | |
| 3,673,684 A | 7/1972 | Muntz | |

(List continued on next page.)

FOREIGN PATENT DOCUMENTS

| | | |
|---|---|---|
| CA | 1 134 706 | 11/1982 |
| CH | 363259 | 8/1962 |
| DE | 1 003 629 | 2/1957 |
| DE | 1 004 518 | 8/1957 |
| DE | 28 41 692 C3 | 6/1981 |
| DE | 23 09 342 C2 | 2/1984 |
| DE | 92 04 144 | 7/1992 |
| DE | 43 13 371 C2 | 5/1994 |
| DE | 43 38 789 C2 | 5/1996 |
| EP | 0 603 617 | 6/1994 |
| EP | 0 691 187 | 1/1996 |
| GB | 714863 | 9/1954 |
| GB | 1 367 445 | 9/1974 |
| GB | 2262904 | 7/1993 |
| JP | 5-317535 | 12/1993 |
| JP | 8-17859 | 2/1996 |
| WO | WO 93/12916 | 7/1993 |
| WO | WO 96/02368 | 2/1996 |

*Primary Examiner*—Douglas D. Watts
(74) *Attorney, Agent, or Firm*—Fish & Richardson PC; Ed Podszus

(57) ABSTRACT

Dry shaving apparatus comprises a drive source provided in a housing; a first shaving unit (111) having a first outer cutter and a first undercutter coupled to the drive source and mounted for movement beneath said first outer cutter, and a second shaving unit (112, 113), having a second outer cutter and a second undercutter coupled to the drive source and mounted for oscillatory movement beneath said second outer cutter. The first outer cutter is coupled to the drive source and is mounted for oscillatory movement to serve as a skin agitation member; and the first outer cutter and the second undercutter are arranged to be driven at the same frequency by the drive source.

28 Claims, 41 Drawing Sheets

U.S. PATENT DOCUMENTS

| | | | | |
|---|---|---|---|---|
| 3,855,697 | A | 12/1974 | Meyer et al. | |
| 4,038,747 | A | 8/1977 | Upton | 30/34.2 |
| 4,174,569 | A | 11/1979 | Schenk et al. | |
| 4,428,117 | A | 1/1984 | Horii et al. | |
| 5,185,926 | A | 2/1993 | Locke | |
| 5,398,412 | A | 3/1995 | Tanahashi et al. | |
| 5,473,818 | A | 12/1995 | Otsuka et al. | |
| 5,704,126 | A | 1/1998 | Franke et al. | |
| 5,946,806 | A | 9/1999 | Watanabe et al. | |
| 6,223,438 | B1 | 5/2001 | Parsonage et al. | |

| CUTTER TRAVEL (mm) | VERTICAL TRAVEL (mm) |
|---|---|
| 2.60 | 0.17 |
| 3.00 | 0.24 |
| 3.60 | 0.36 |

DRY SHAVING APPARATUS

This is a division of application Ser. No. 09/216,361, filed Dec. 18, 1998, now U.S. Pat. No. 6,308,414, which is a continuation of PCT/EP97/03542, filed Jul. 4, 1997.

The present invention relates to dry shaving apparatus comprising: a drive source provided in a housing; a first shaving unit having a first outer cutter and a first undercutter mounted for relative movement therebetween; and a second shaving unit having a second outer cutter and a second undercutter mounted for movement beneath said second outer cutter.

Although this specification is primarily concerned with shavers having shaving units extending in a longitudinal direction provided with linearly oscillating inner cutters as described in U.S. Pat. No. 5,185,926 or German Patent DE 43 38 789 C2, it will be understood that the principles described may also readily be applied in dry shavers provided with rotating inner cutters as known by Japanese patent publication JP-A-5 317 535 or WO 96/02368.

In addition this application is also concerned with dry shaving apparatus provided with at least two shaving units being fixedly mounted on a shaving housing—U.S. Pat. No. 5,185,926—or mounted floatably in a shear head frame—DE 43 13 371 C2—or mounted in a shear head being pivotably mounted on a shaver housing—WO/93/12916.

One example of linear dry shaving apparatus is known from WO 93/12916. This known apparatus includes in one embodiment three individual floating shaving units mounted in a pivotable head. The units are arranged in parallel with one unit constructed as a long hair cutter positioned centrally between two units constructed as short hair cutters. The spring biasing in the individual units is such that during use the cutter units can move up and down to follow the contours of the face and thus to improve contact with the skin during use.

It is also known from DE-B-1 003 629 to provide beneath a single perforate foil an array of four separate undercutters. The two outboard undercutters are driven together and separately from the two inboard undercutters. This allows the inboard undercutters to be driven in anti-phase with respect to the outboard undercutters to produce a degree of dynamic balancing and reduce vibration of the housing.

Japanese Application JP-B2-8-17859 discloses a reciprocatory electric shaver comprising a central main shaving unit, having an outer foil cutter and an inner cutter, and two trimmers on respective sides of the main cutter. According to this proposal, the undercutter of the main shaving unit is caused to reciprocate in anti-phase with the undercutters of the trimmers to improve dynamic balancing.

Moreover, it is also known from German patent No. 1 004 518 and from DE-A-23 09 342 to provide a shaver with a single foil-type cutter assembly and two comb-like trimmer assemblies on respective sides of the foil-type cutter assembly, where each trimmer assembly has a movable blade in contact with the skin, which blade is directly connected to the undercutter of the foil-type cutter assembly. This allows limited catching by the trimmers of long hairs missed by the foil-type cutter.

Although foil type dry shaving apparatus operates very effectively to remove stubble, problems sometime arise with hairs of a length representing two or three days beard growth. Such hairs no longer readily penetrate through the apertures of the foil and therefore are not cut by the interaction between the undercutter and the foil. Various attempts have been made over the years to combat this problem. For example, U.S. Pat. No. 2,309,431 discloses a dry shaver having a pair of shaving units in which not only the undercutters but also the outer skin-engaging cutters are caused to oscillate in anti-phase. By thus moving the cutting heads on the skin, the hair receiving openings were intended to move over the skin surface with a "scanning" action, so that all parts of the skin beneath the cutting head would be successively brought into register with the hair receiving openings. However, to avoid excessive discomfort it was considered inadvisable to reciprocate the outer cutting heads at more than 3,000 revolutions per minute although the undercutters were caused to reciprocate at from 3 to 5 times that frequency. Moreover, making use of a somewhat complex cam operated drive assembly, the outer cutters were reciprocated in opposite directions which produces a stationary skin zone mid-way between the cutters.

U.S. Pat. No. 4,174,569 discloses another proposal in which an outer cutter shearing cutter is caused to oscillate in contact with the skin, whilst a further cutter oscillates beneath the outer cutter. As in U.S. Pat. No. 2,309,431, the frequency of oscillation of the inner cutter was considerably higher than that of the outer cutter.

These attempts to improve the penetration of long beard hairs through a perforated outer cutter have not been particularly successful. Moreover, the prior art seems to contain no appreciation of any possible interaction between adjacent shaving units.

An object of the invention is to provide a dry shaving apparatus in which the penetration of hairs through a perforate outer cutter is improved.

Another object of the invention is to provide dry shaving apparatus in which the hairs are positioned optimally for cutting following penetration of the outer cutter.

Another object of the invention is to provide dry shaving apparatus in which individual cutters may be driven with a desired stroke and phasing in a simple manner.

According to one aspect of the invention the dry shaver initially defined is characterised in that the first outer cutter is mounted for oscillatory movement to serve as a skin agitation member; and the first outer cutter and the second undercutter are coupled to the drive source to be oscillated at the same frequency.

Preferably, the first outer cutter is displaced in phase from the second undercutter by an angle in the range −120° to 120°.

In one embodiment, the first outer cutter is driven in phase with the second undercutter.

In another embodiment, the first outer cutter leads or lags the second undercutter in phase by substantially 90°.

Preferably, a third shaving unit for short hairs is provided and comprises a third perforate outer cutter and a third undercutter mounted for oscillatory movement beneath the third outer cutter, the first unit being provided between the second and third shaving units.

In one embodiment, the first outer cutter lags the third undercutter by substantially 90°.

According to a further aspect of the invention, there is provided a dry shaving apparatus comprising: a drive source provided in a housing; a first shaving unit coupled to the drive source and having a first outer cutter and a first undercutter mounted for relative movement therebetween; and at least one further shaving unit having a second outer cutter and a second undercutter coupled to the drive source and mounted for movement beneath said second outer cutter; characterised in that: at least the first outer cutter of the first shaving unit is coupled to the drive source and is mounted for oscillatory movement to agitate the skin under a further of the shaving units.

It will be understood that by activating the skin using the active unit, the skin surface is caused to move to and fro across the skin-engaging surface of the or each inactive unit. This aids penetration of hairs into the or each inactive unit and enhances the chance that the hairs will be cut with minimal discomfort. Further enhancement may be achieved by phase or frequency adjustment as will be described.

In one embodiment of the invention, two inactive shaving units are provided on respective sides of an active shaving unit. The outer cutter of the active unit may then be driven at the same frequency as the undercutters of the inactive units (synchronous operation) or at a different frequency (asynchronous operation). Where the frequency is the same, the phasing of the undercutters in the inactive units may be optimised with respect to the outer cutter of the active unit.

It is presently believed that the best arrangement is for the undercutter of one inactive unit to lag by a small angle close to zero (for short hairs) and the undercutter of the other inactive unit to lead by 90° (for long hairs). However, the exact phasing may be set by experiment to optimise the shaving performance. It may be preferred to drive the undercutter of one inactive unit in phase with the outer cutter of the active unit and to adjust the phase of the undercutter of the other inactive unit to be optimum for long hairs (leading by about 90°) or, for practical reasons of construction, to drive the undercutters of both inactive units in phase with the outer cutter of the active unit.

Where the outer cutter of the active unit is driven at a different frequency (higher or lower) than the undercutters of the inactive units, no phase adjustment is of course either necessary or possible, since a cyclically varying phase condition will be present.

In a simplified embodiment, only two shaving units are provided, one active and the other inactive. Here again two possibilities exist: either the outer cutter of the active unit is driven at the same frequency as the undercutter of the inactive unit, or at a different higher or lower frequency. Where the frequencies are the same, phase adjustment is possible. For reasons of simplicity, one construction provides for the outer cutter of the active unit to be driven in phase with the undercutter of the inactive unit. In such a construction, the undercutter of the active unit may be static or may be driven in anti-phase with the outer cutter.

In any of the embodiments, it may be advantageous to adapt the skin-engaging surface of the outer cutter in the active unit for enhanced grip on the skin, e.g. by roughening or by applying a high-friction coating. Moreover, to maximise the amount of skin movement over the inactive units, it may be advantageous to provide the skin-engaging surface of the (or each) inactive unit with a low-friction coating. In some circumstances, it may prove advantageous to provide the skin-engaging surface of the active unit with a low-friction coating.

For a better understanding of the invention, and to show how the same may be carried into effect, reference will now be made by way of example to the accompanying drawings, in which.

Figure 1A:
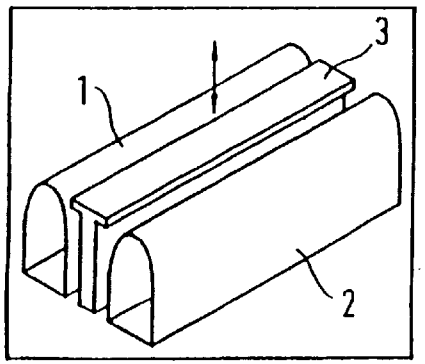
FIG. 1 is a schematic diagram showing various possibilities for oscillating the outer cutter of a long hair cutter disposed between two short hair cutters.
Figure 1B:
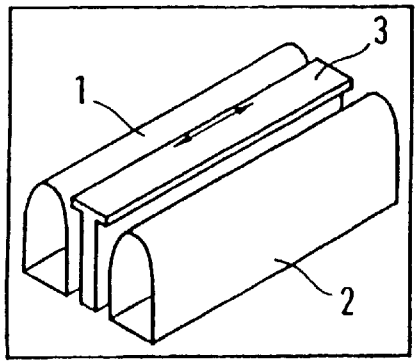
Figure 1C:
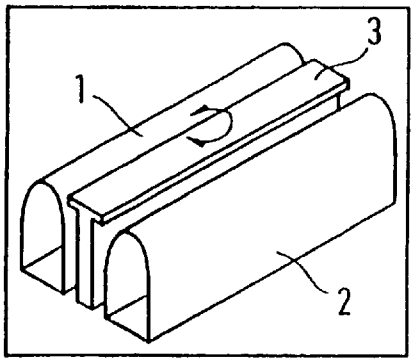
Figure 1D:
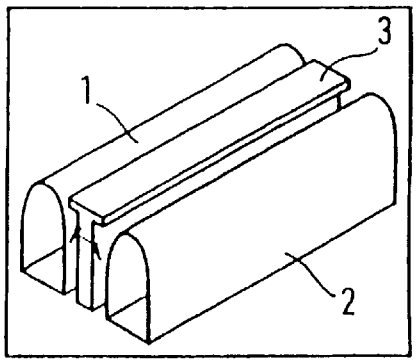
Figure 1E:
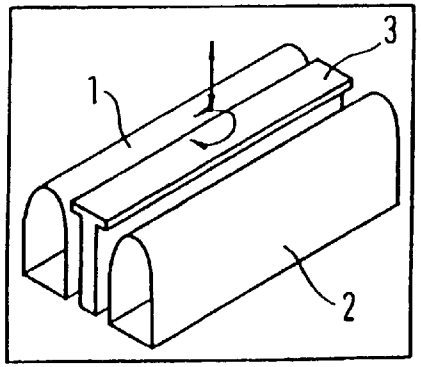
Figure 1F:
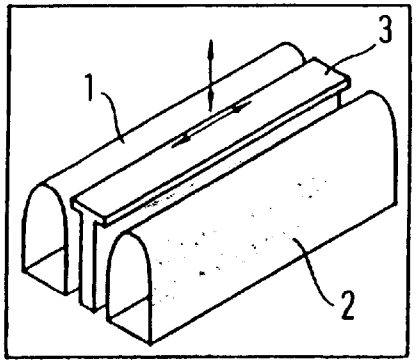
Figure 1G:
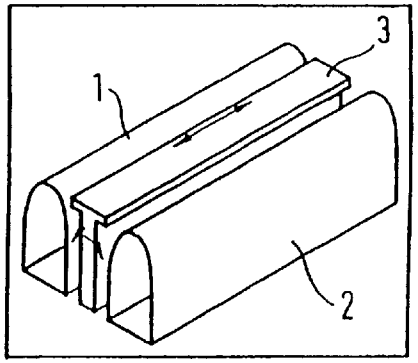
Figure 2:
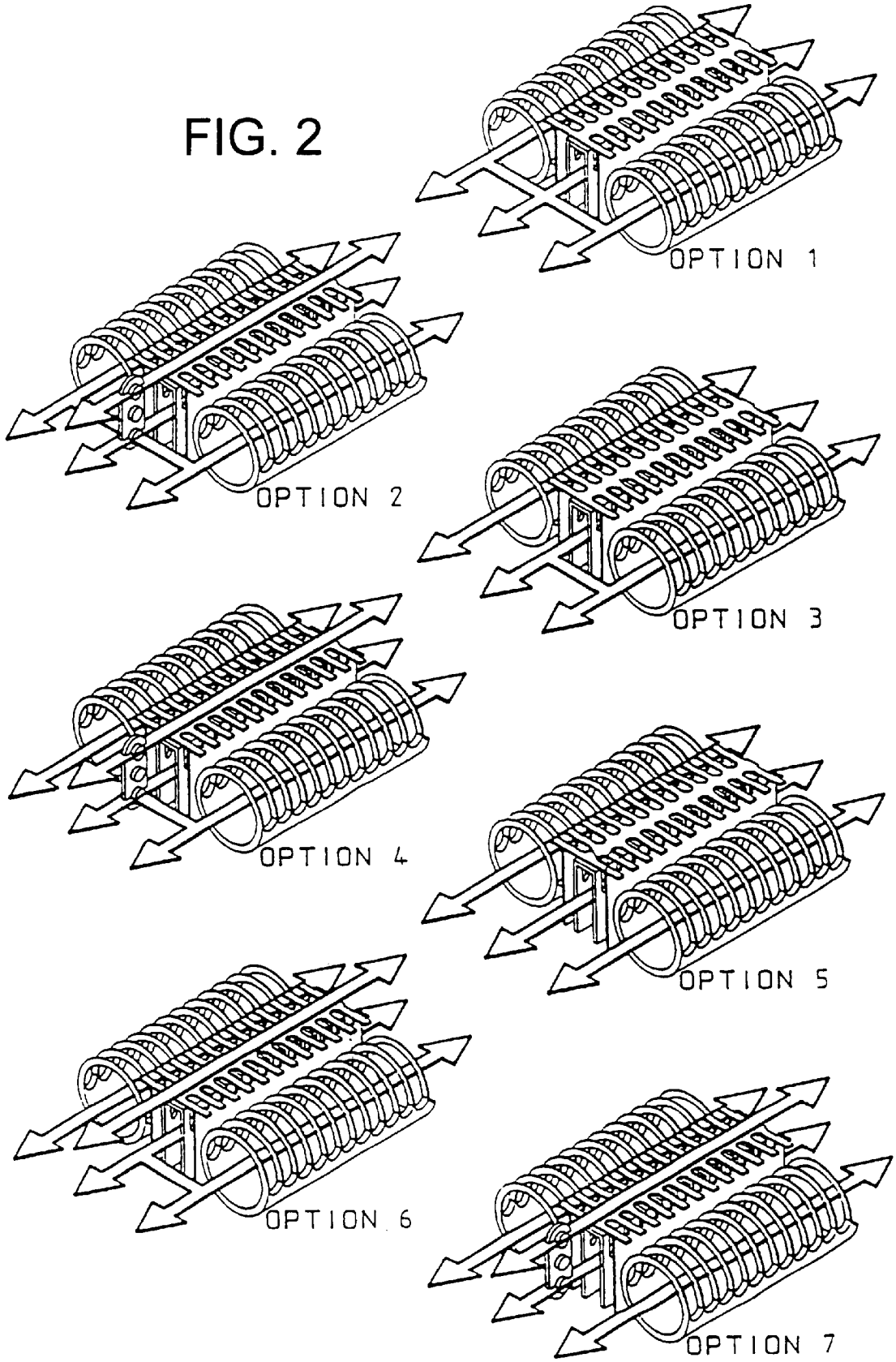
FIG. 2 shows a series of options for driving the undercutters of two short hair cutters and the outer cutter and undercutter of a central long hair cutter.
Figure 7A:
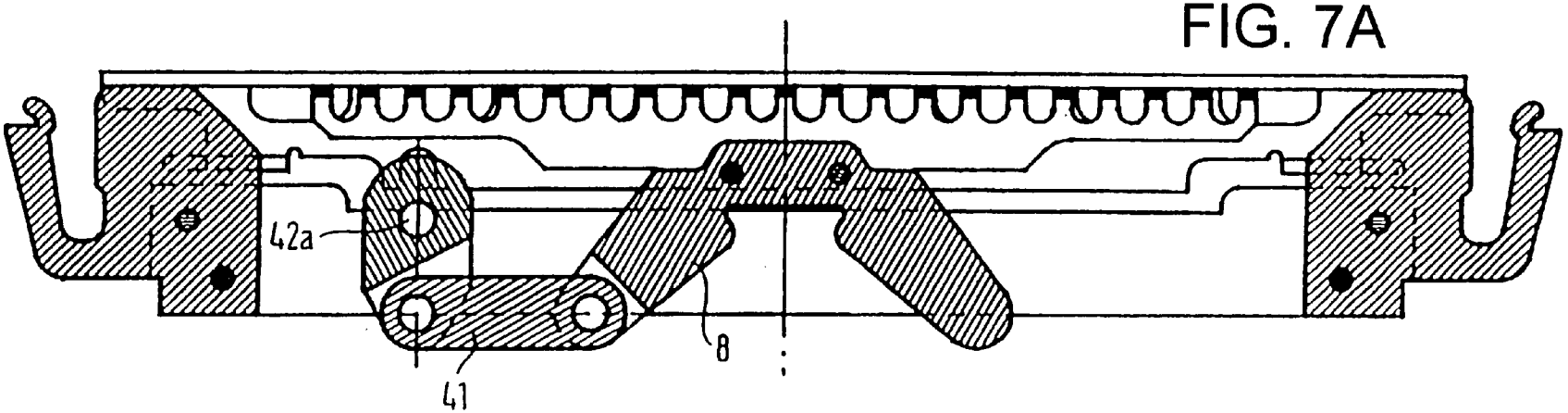
Figure 7B:
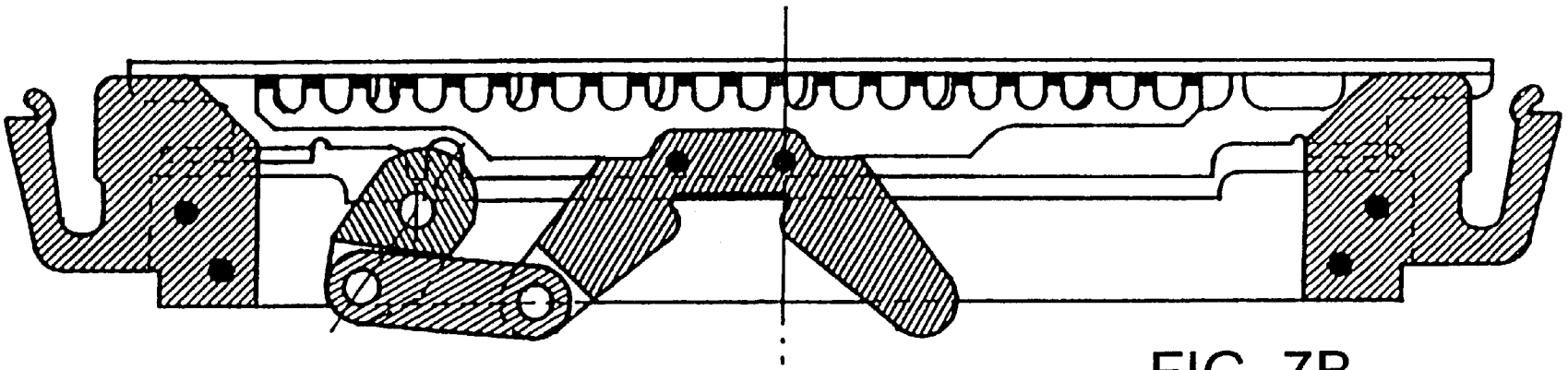
Figure 8:
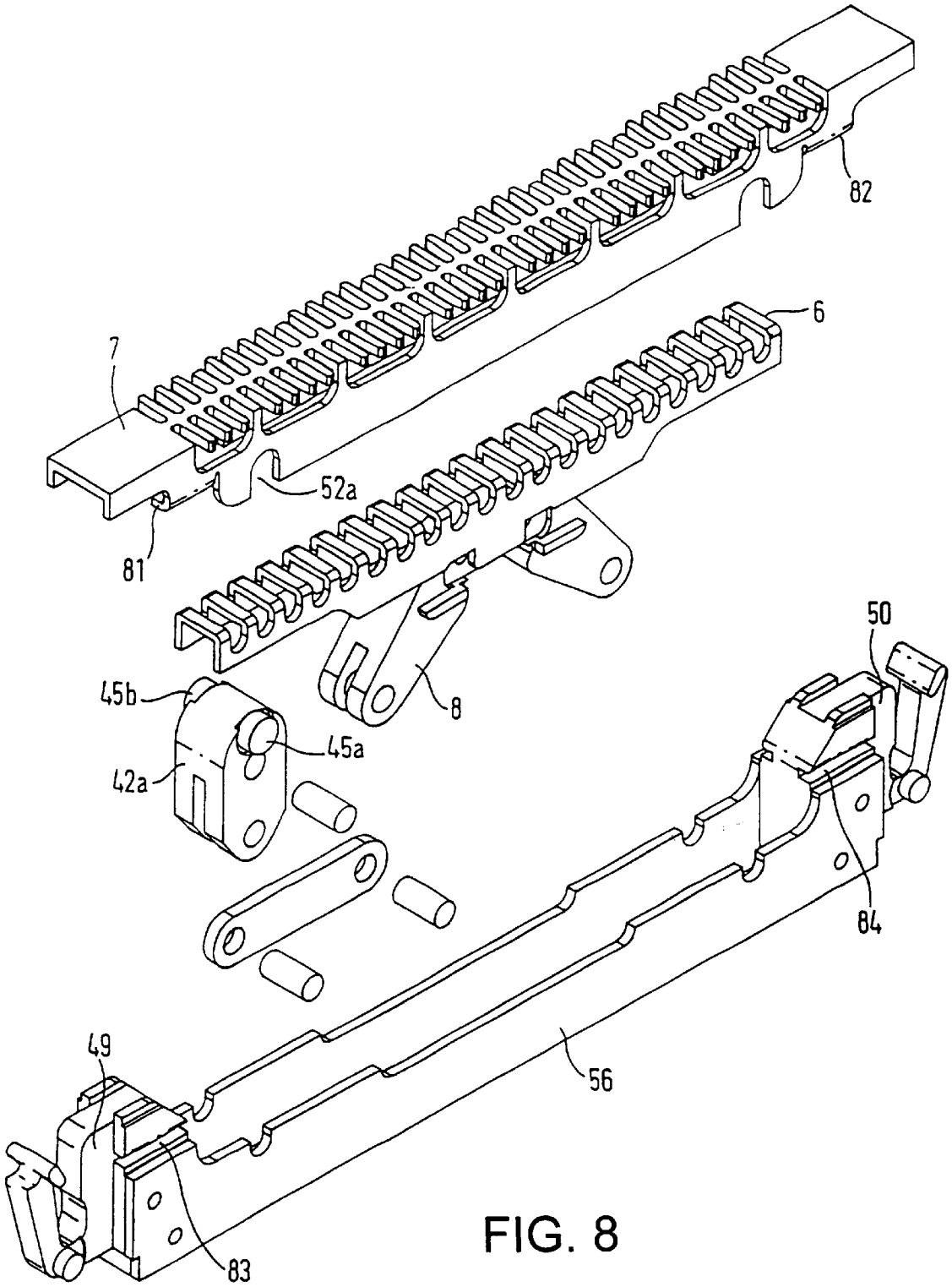
Figure 8A:
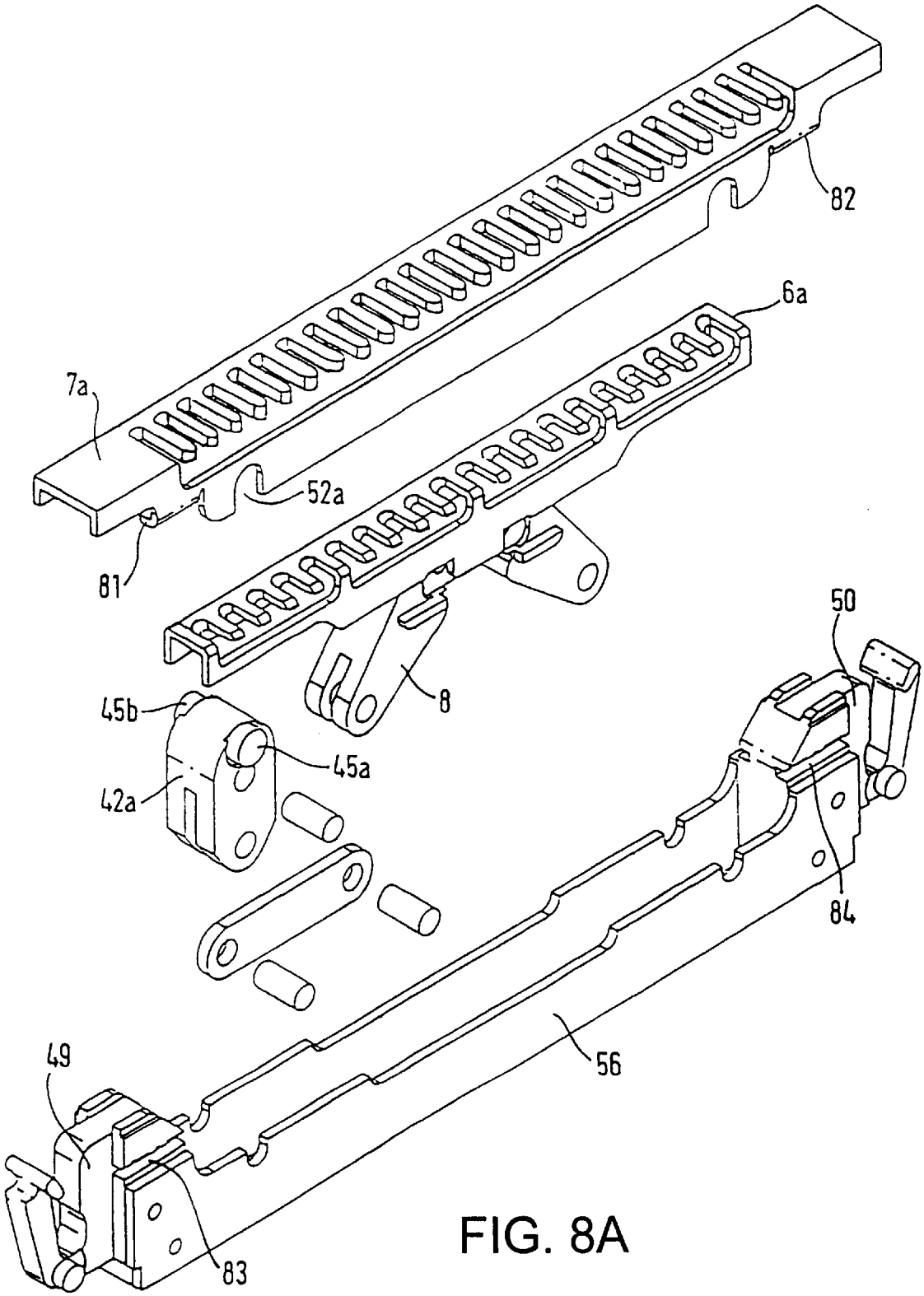
Figure 9:
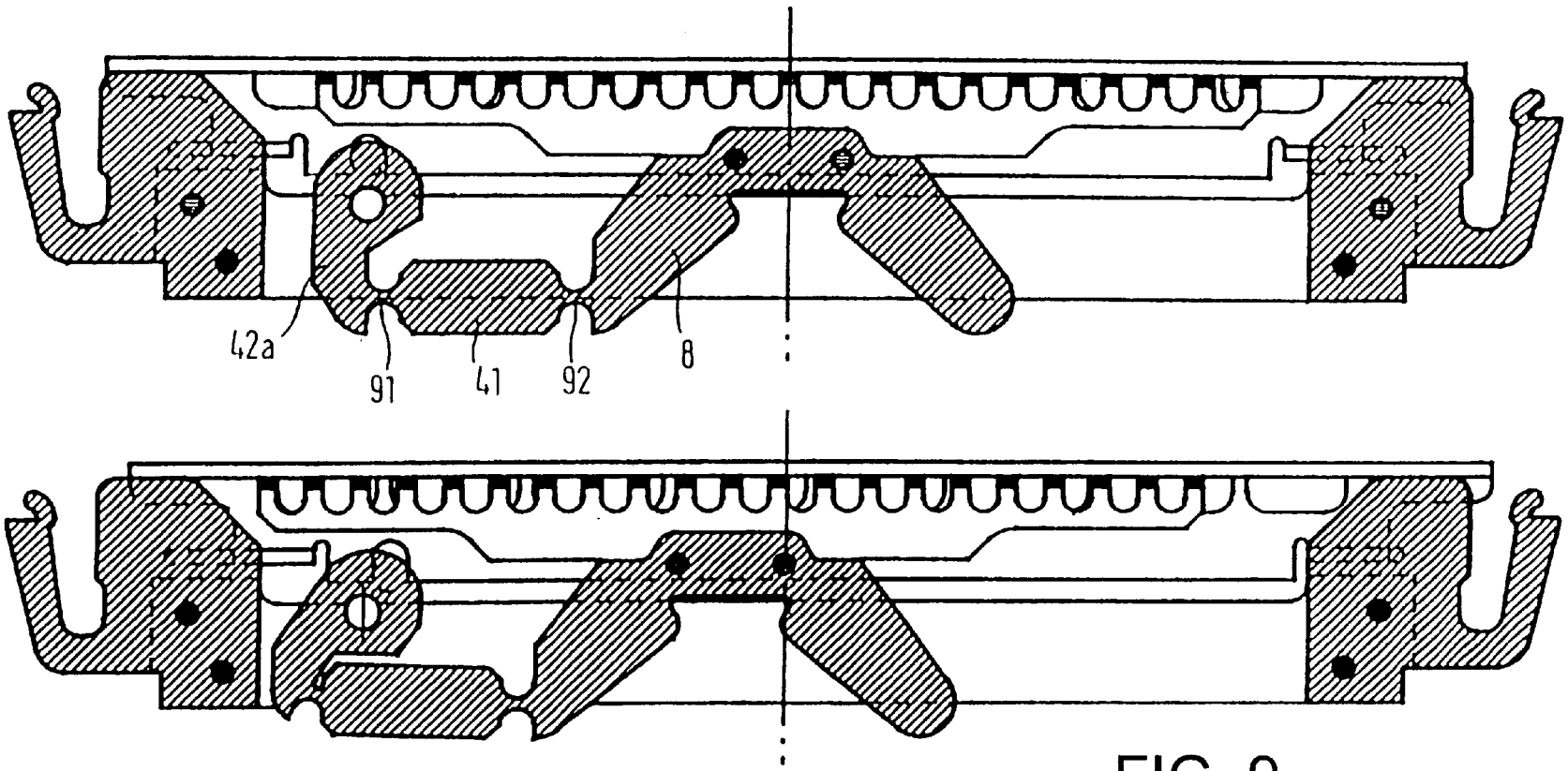
Figure 10A:
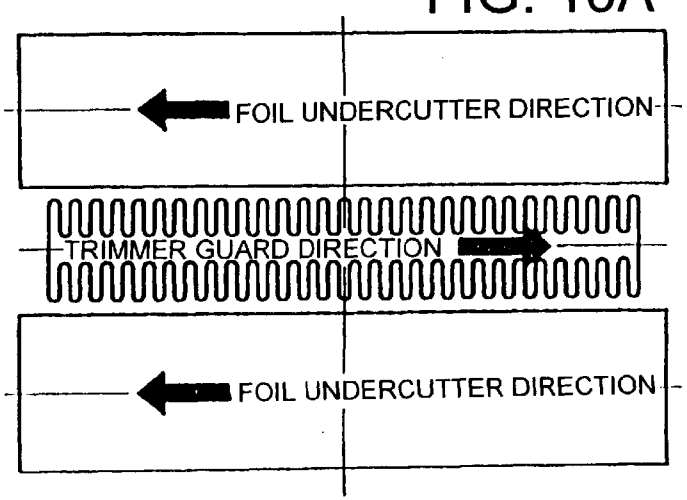
Figure 10B:
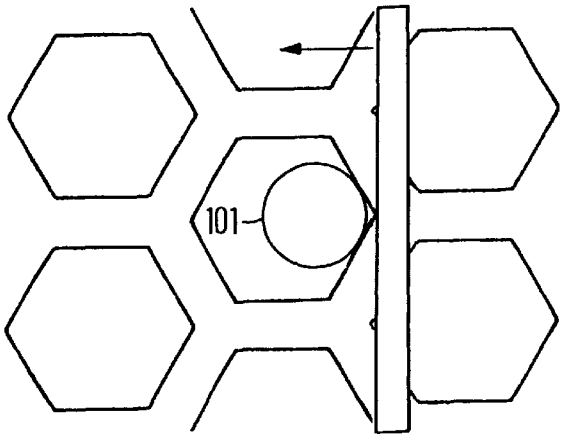
Figure 10C:
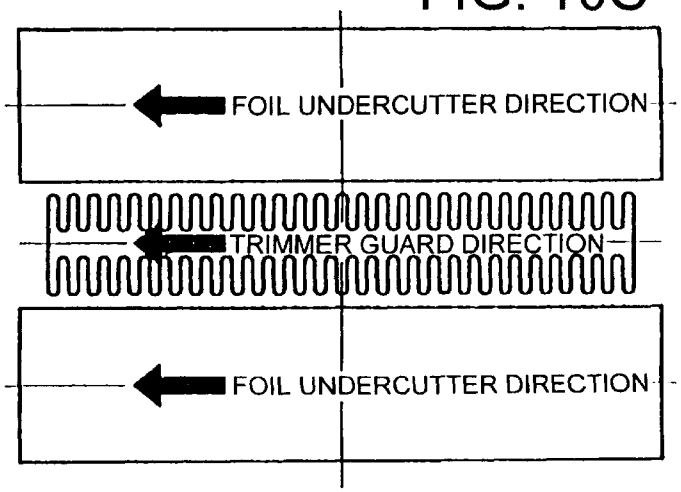
Figure 10D:
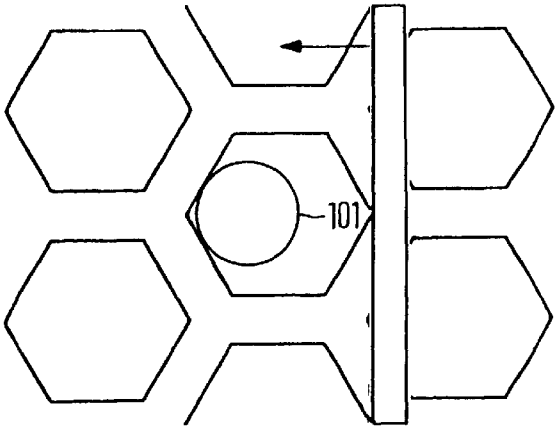
Figure 11:
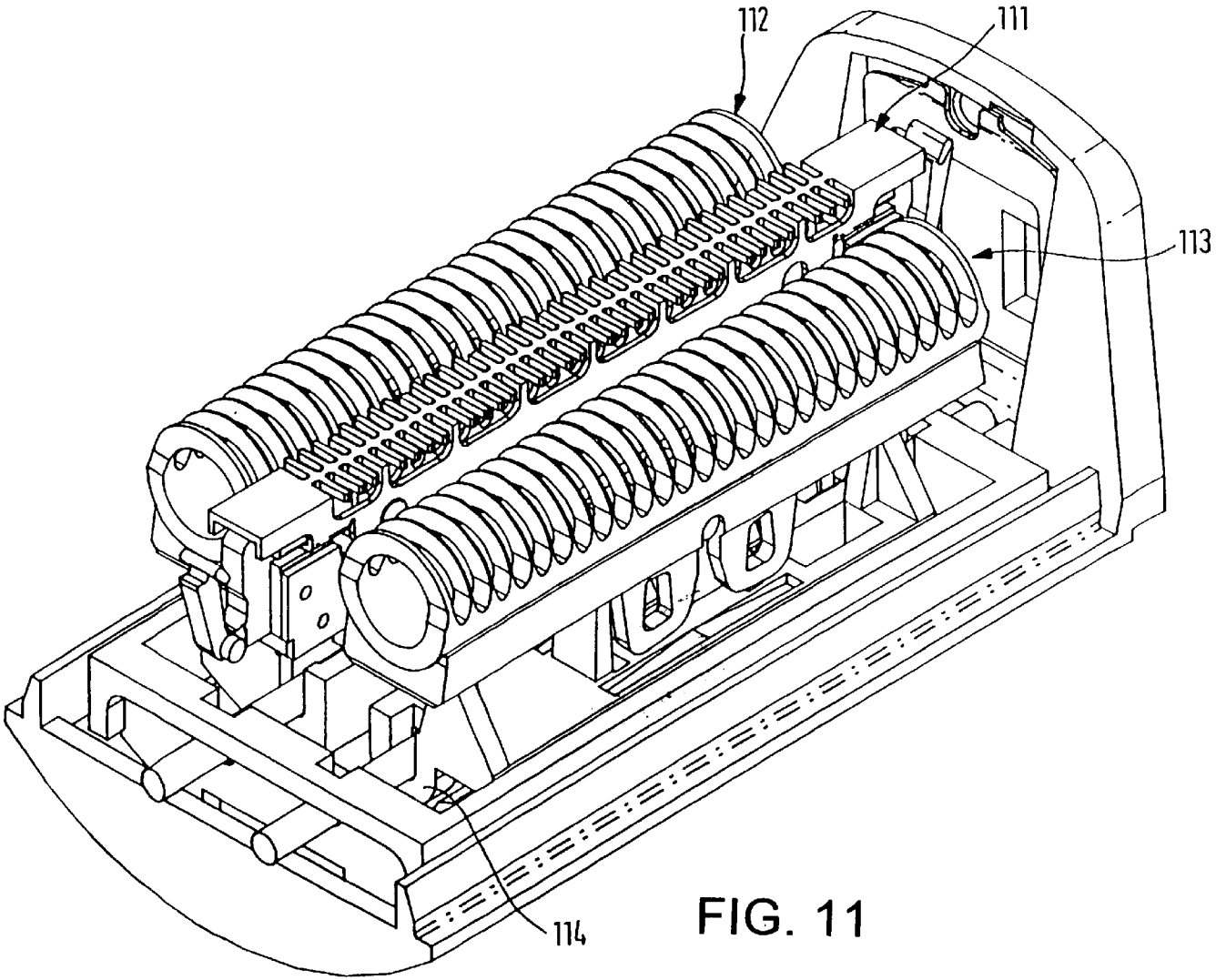
Figure 12:
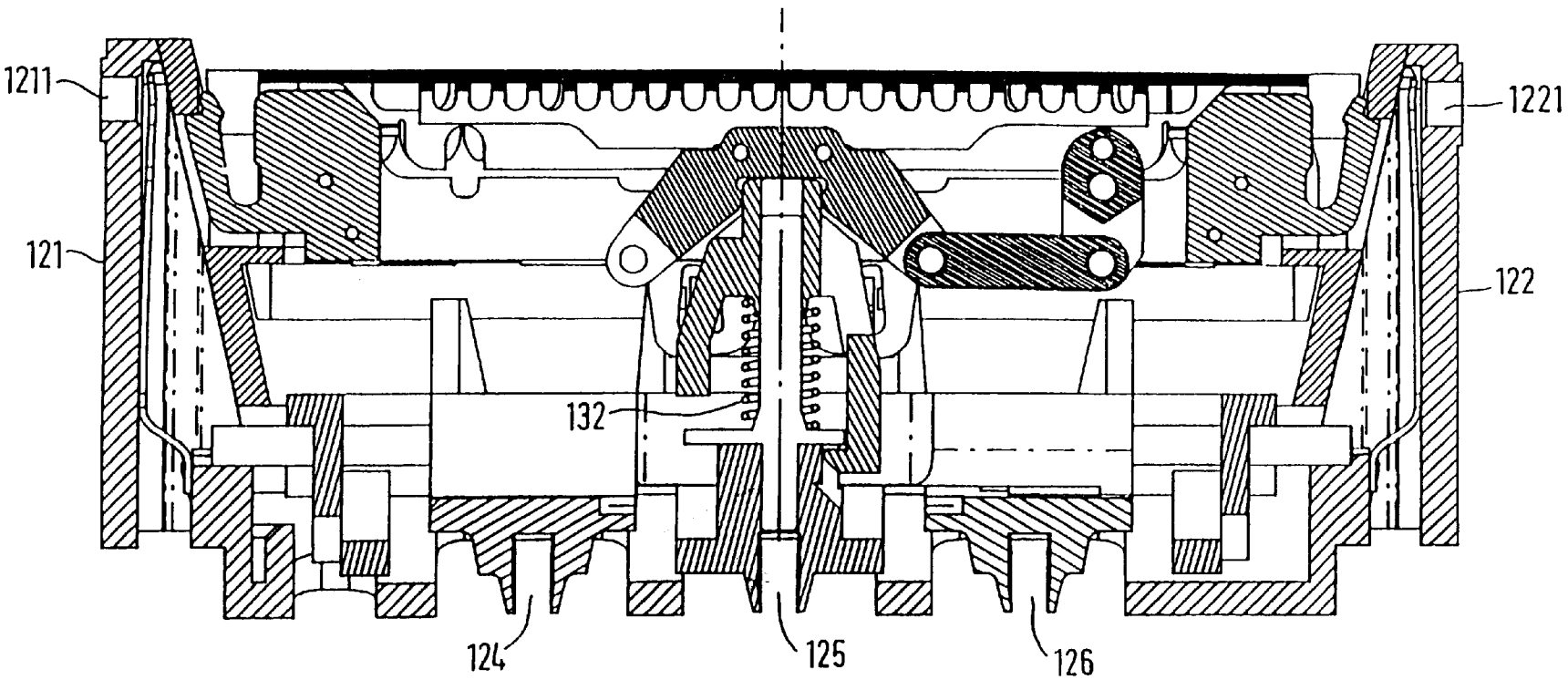
Figure 13:
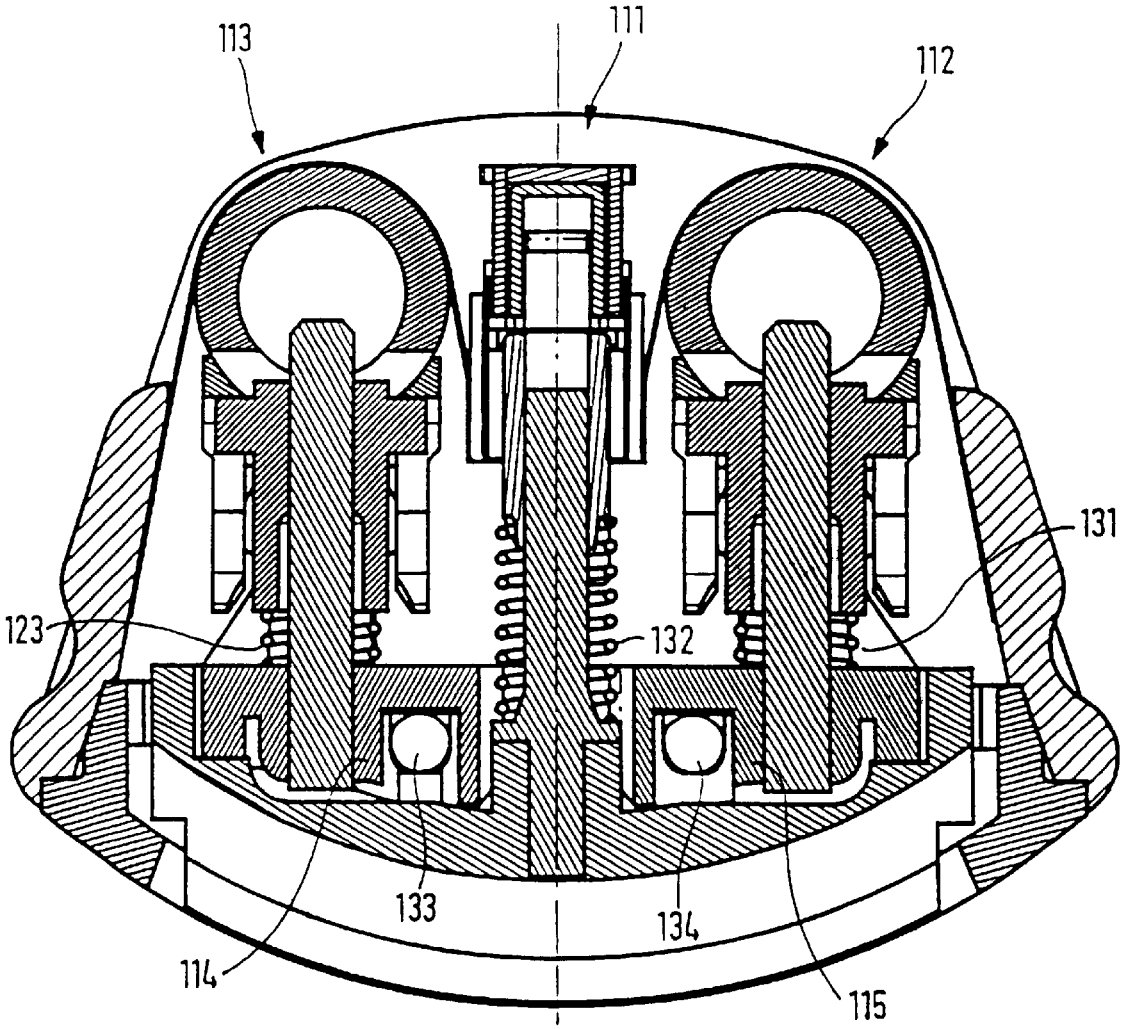
Figure 14:
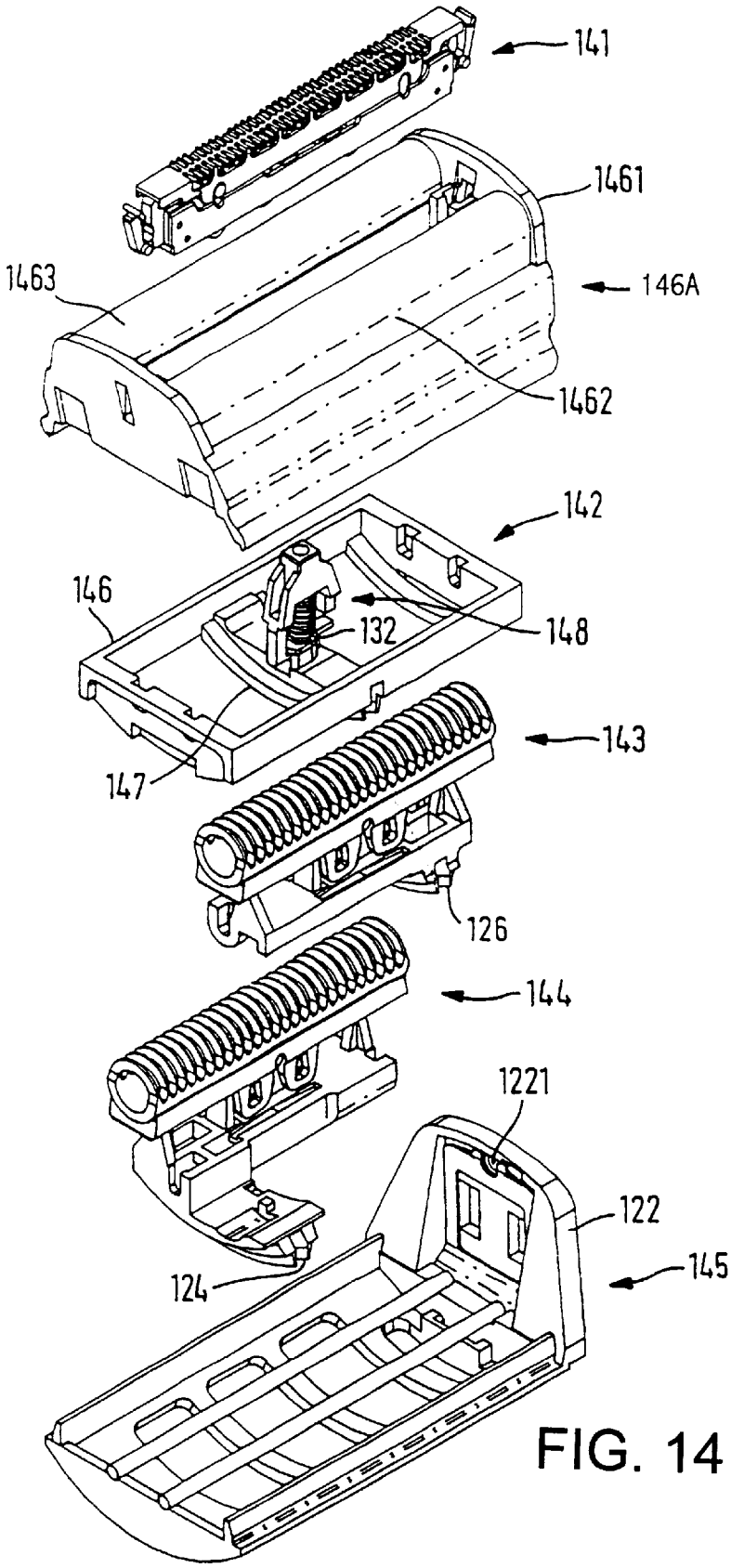
Figure 14A:
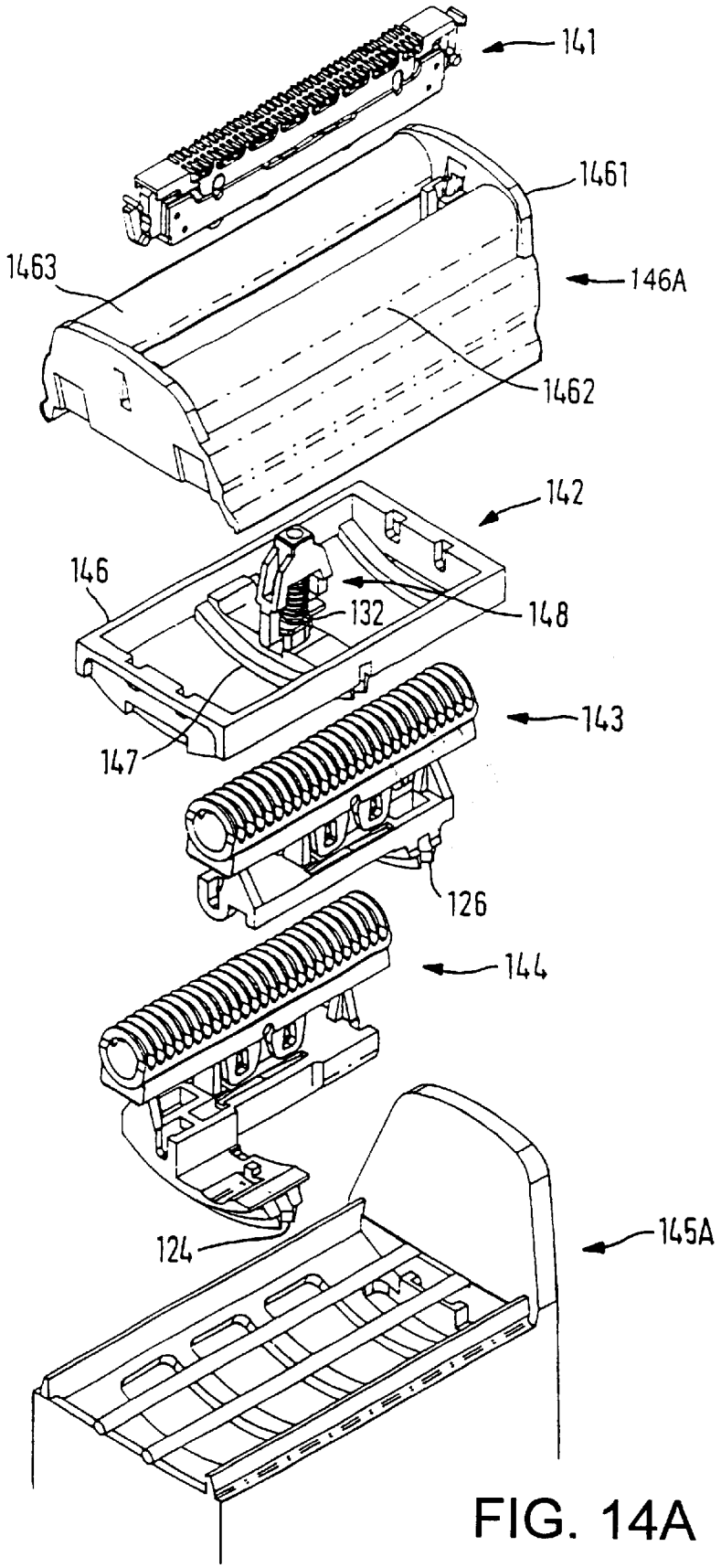
Figure 15:
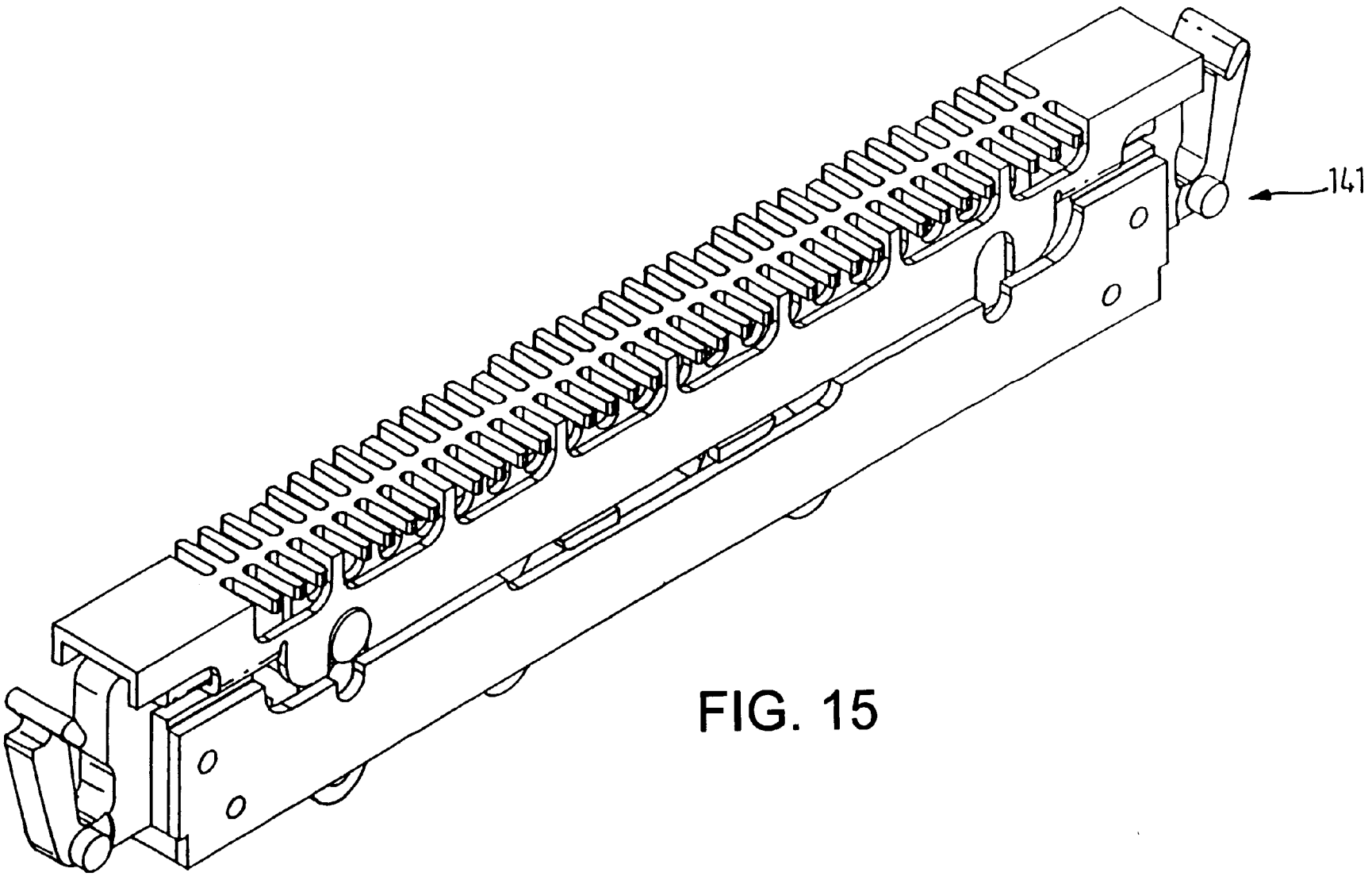
Figure 16:
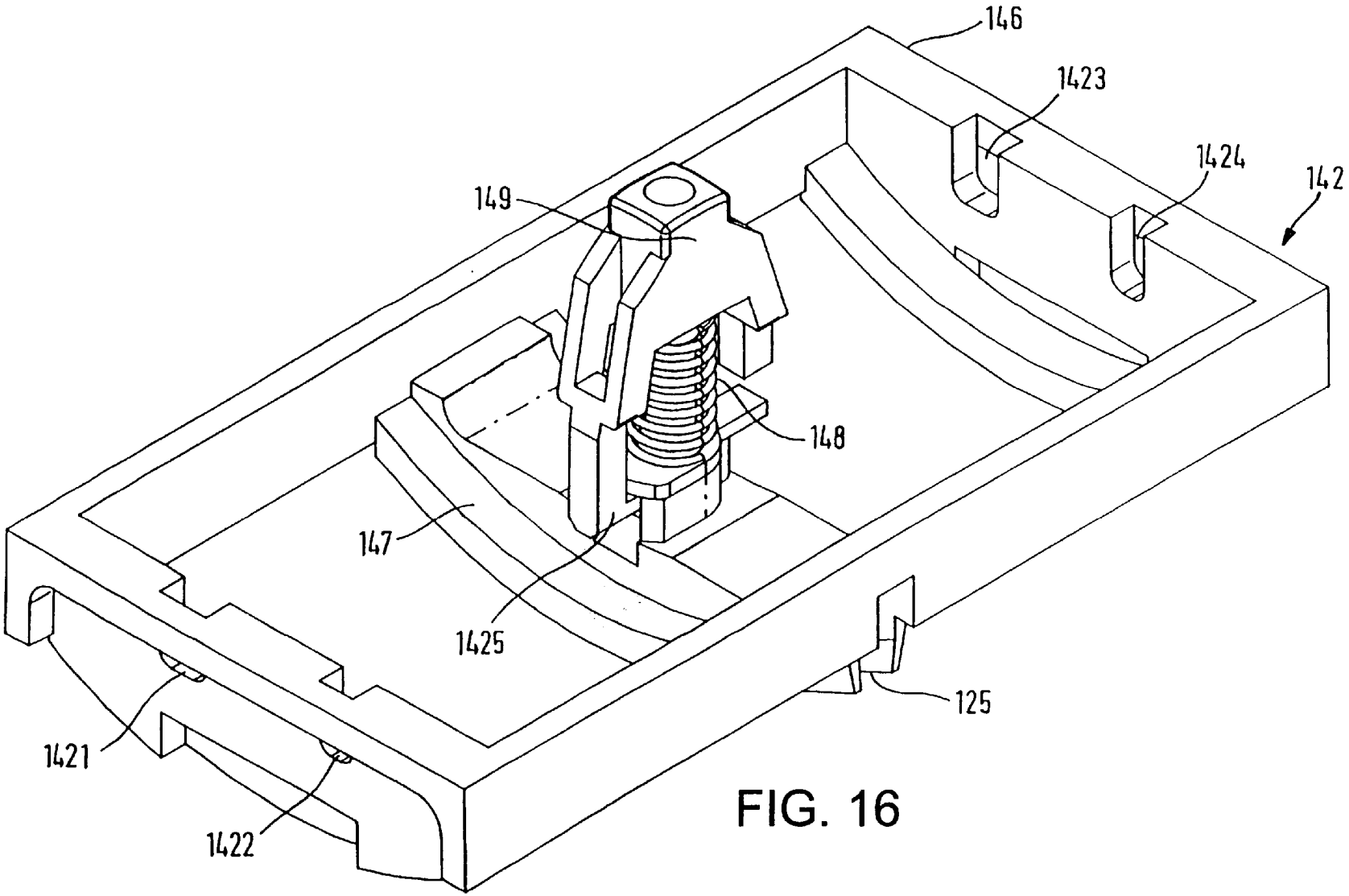
Figure 17:
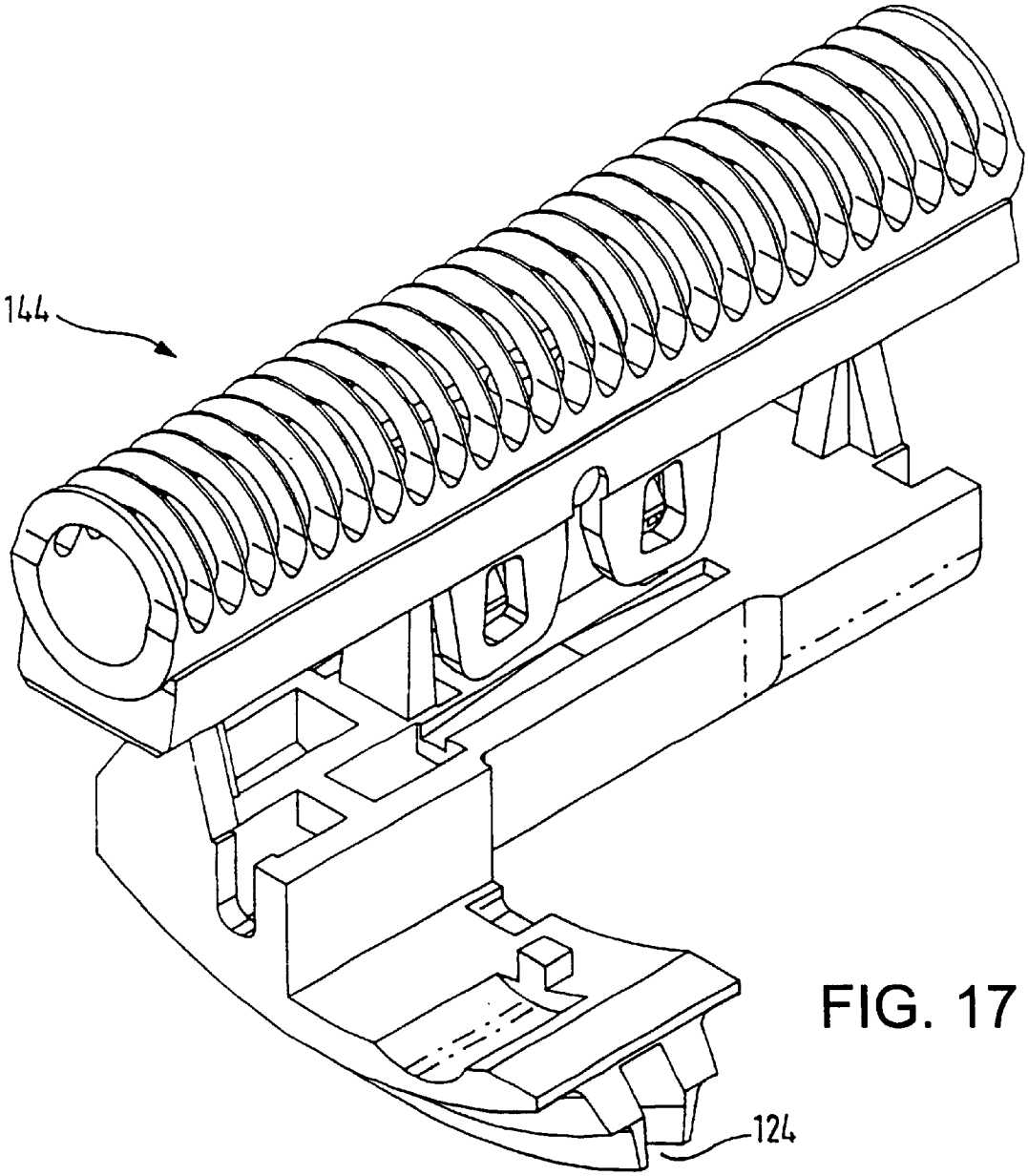
Figure 18:
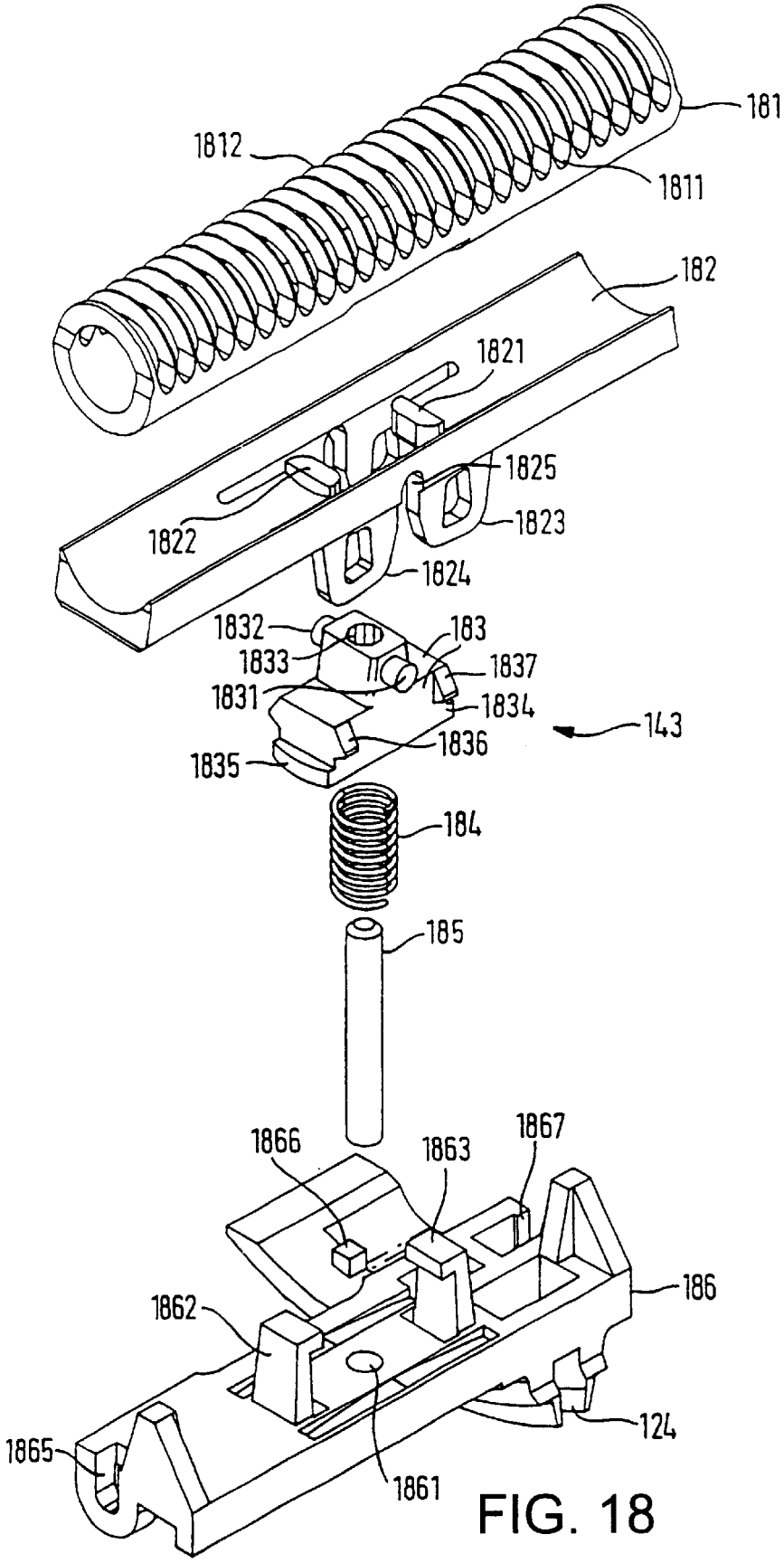
Figure 19:
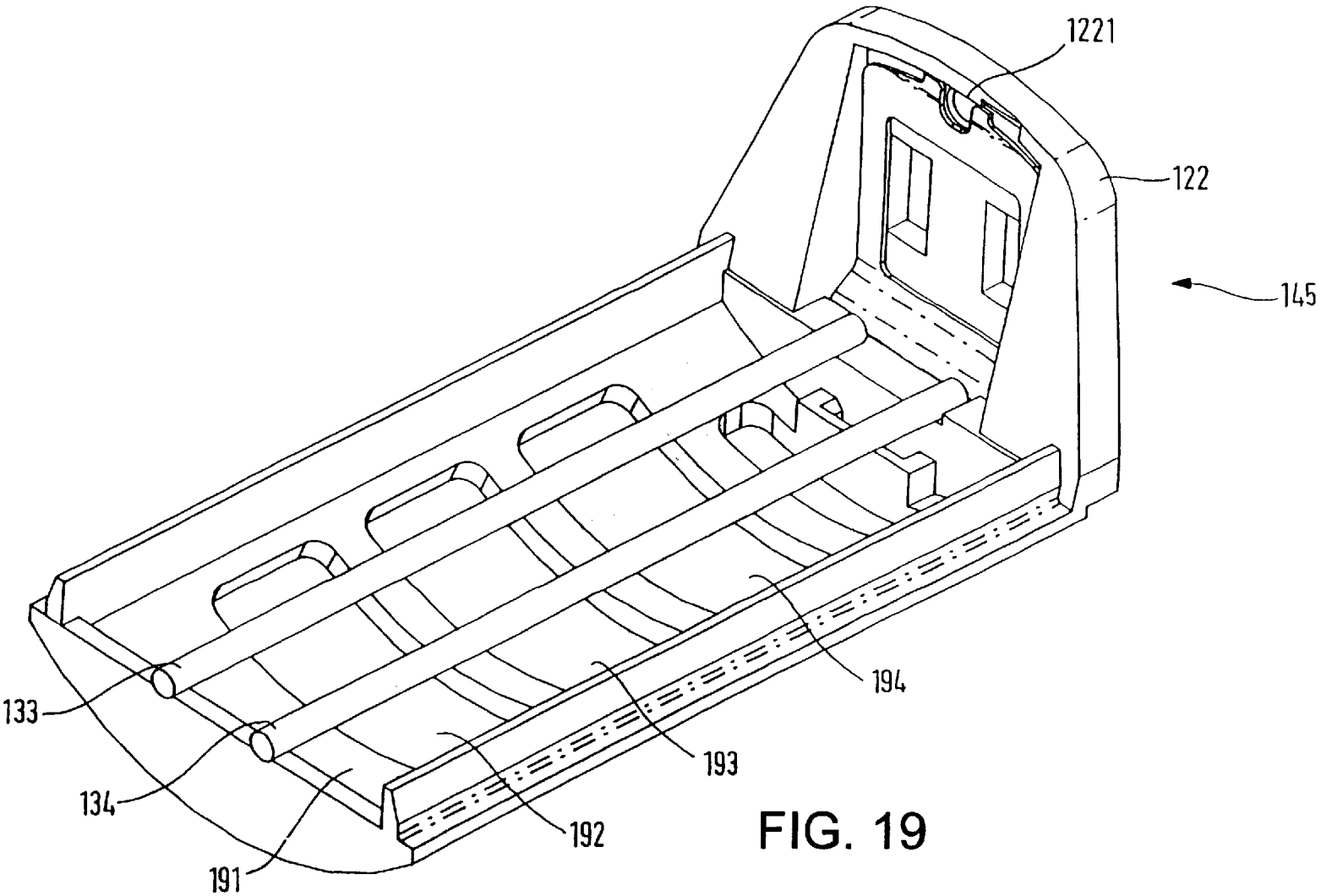
Figure 20:
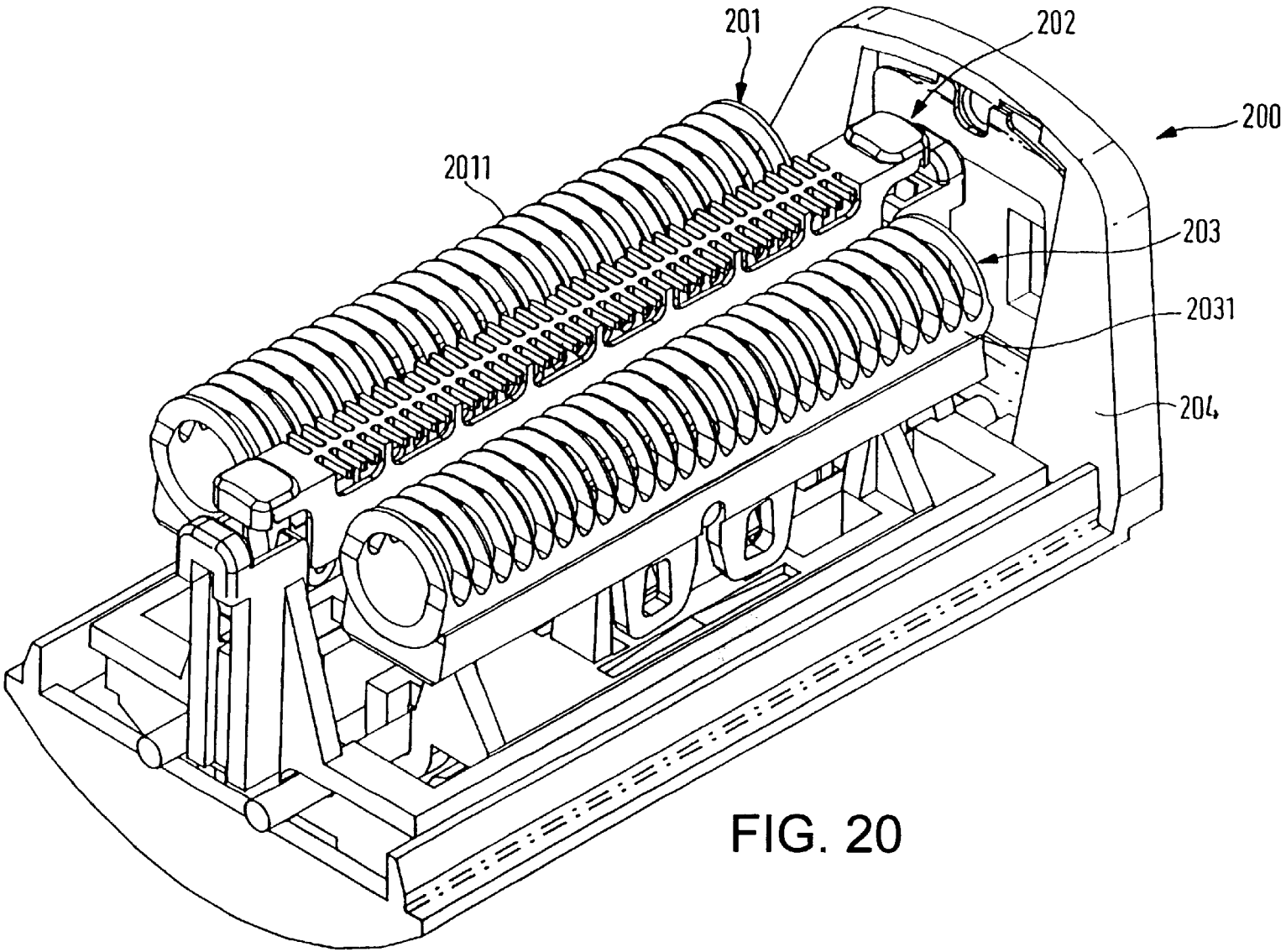
Figure 21:
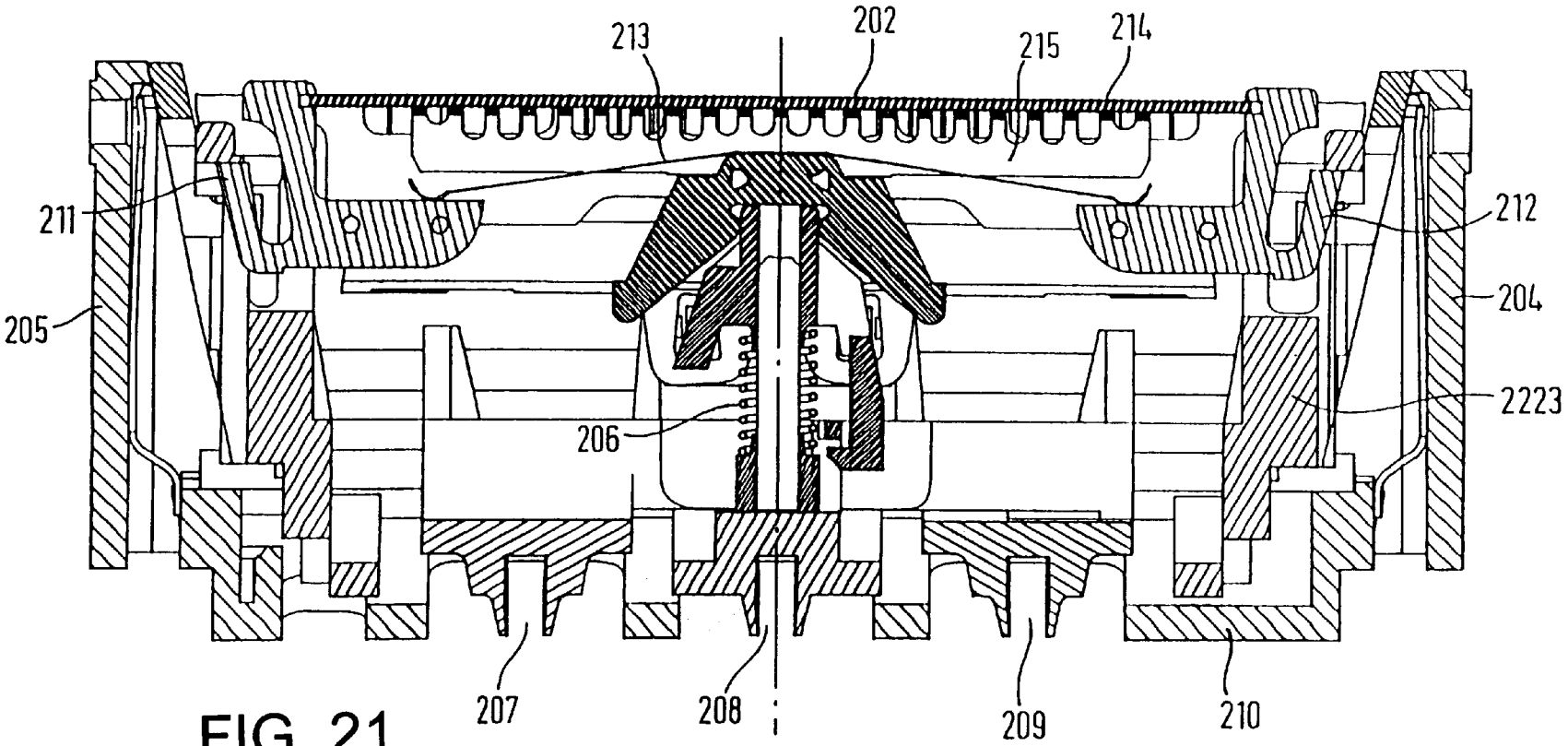
Figure 22:
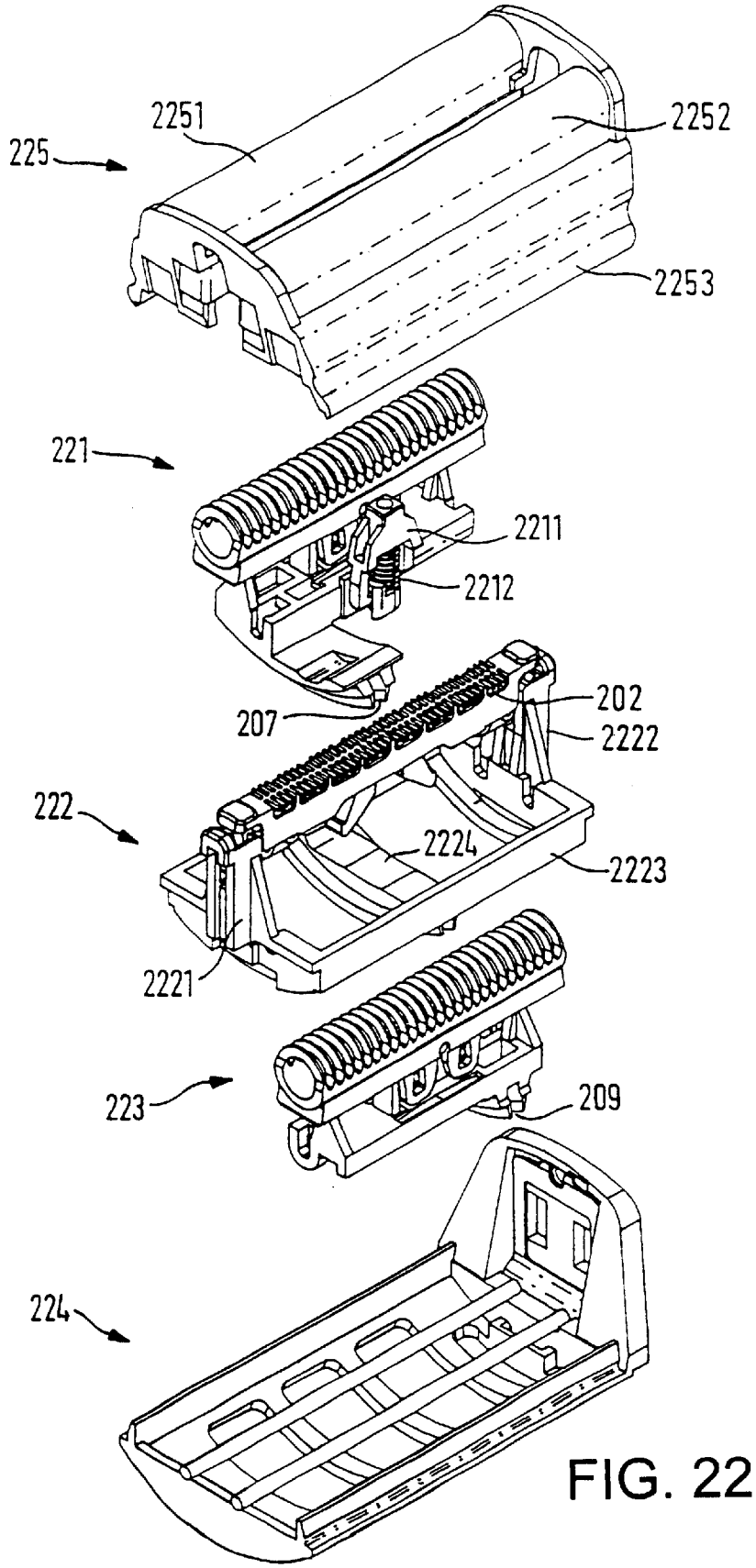
Figure 23:
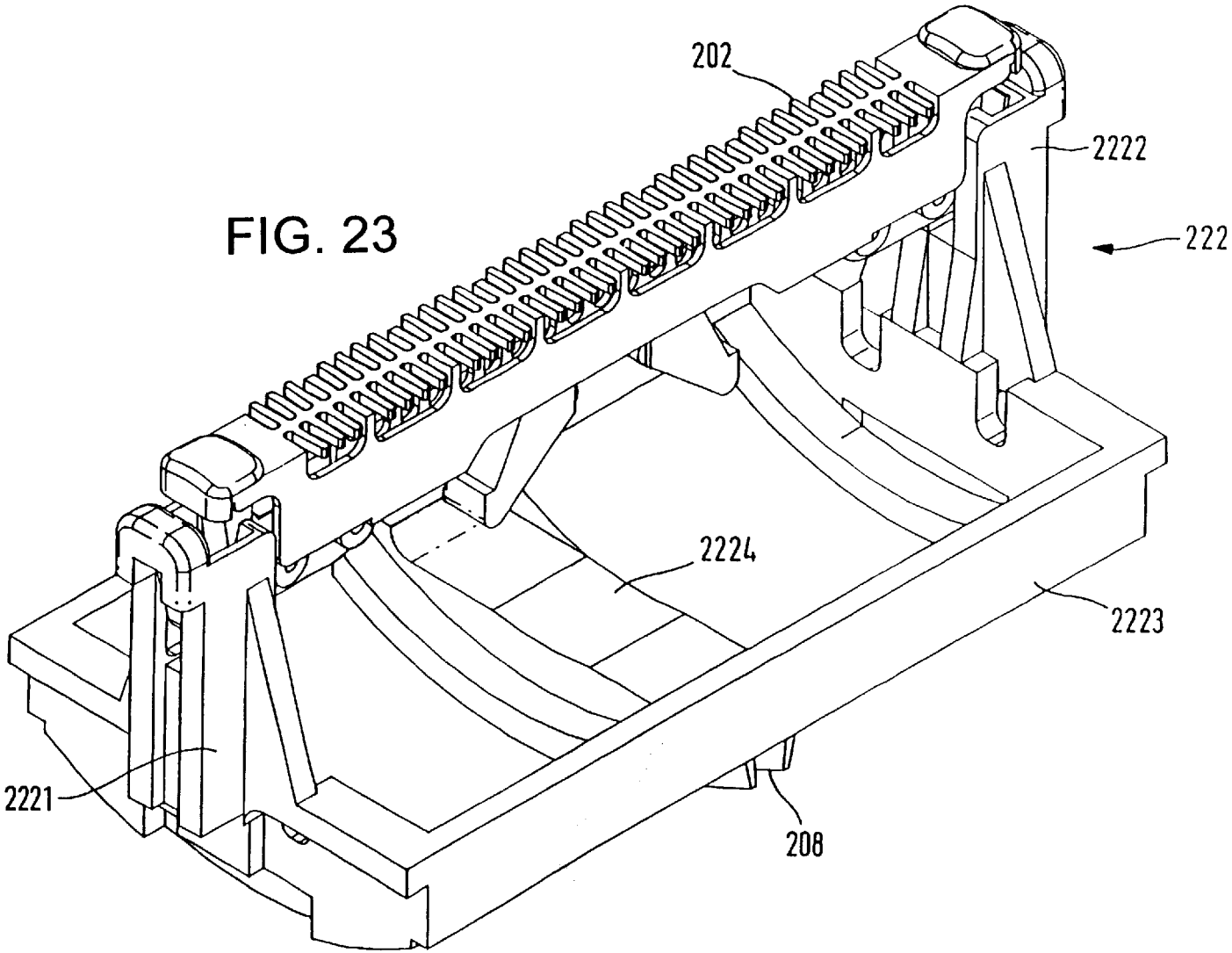
Figure 24:
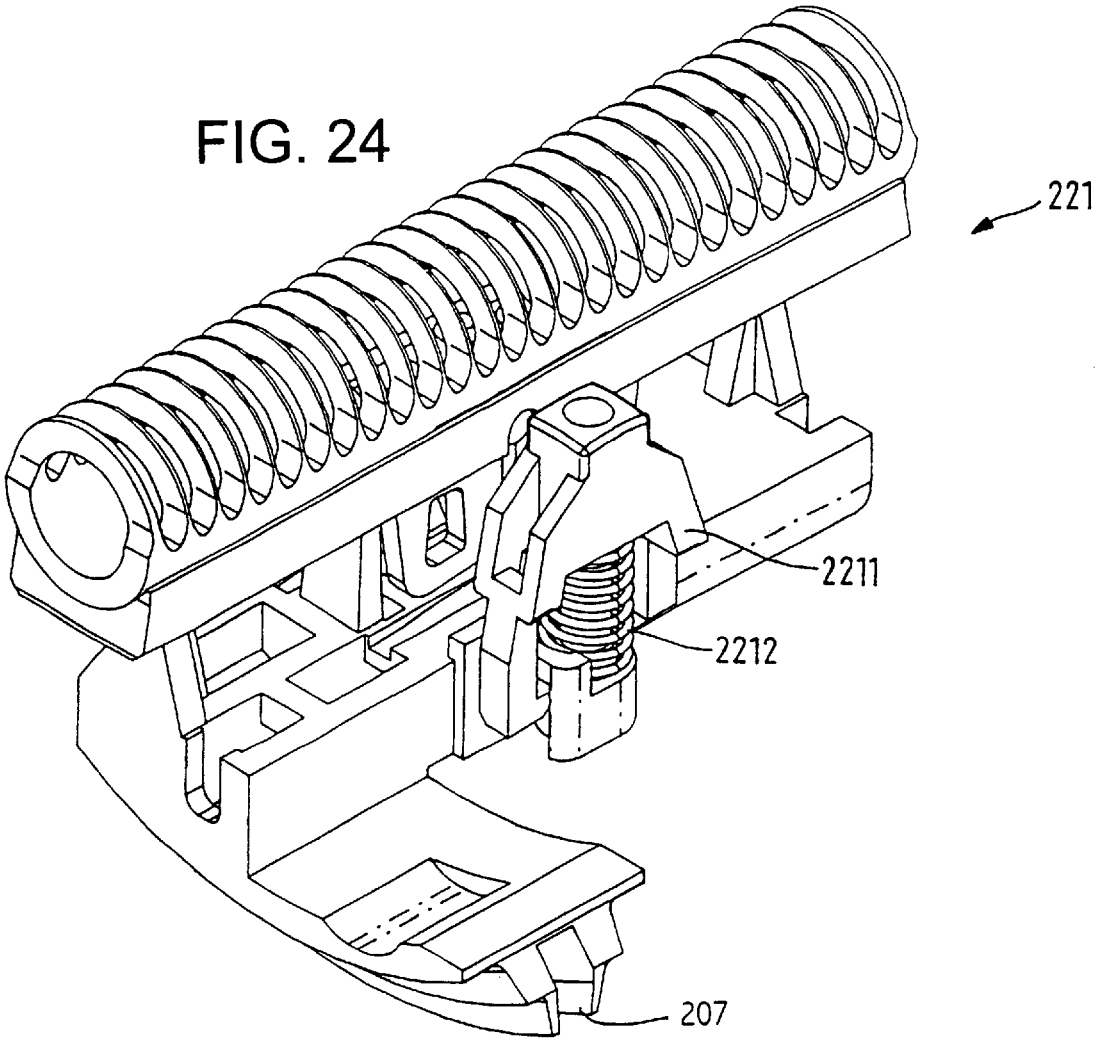
Figure 25:
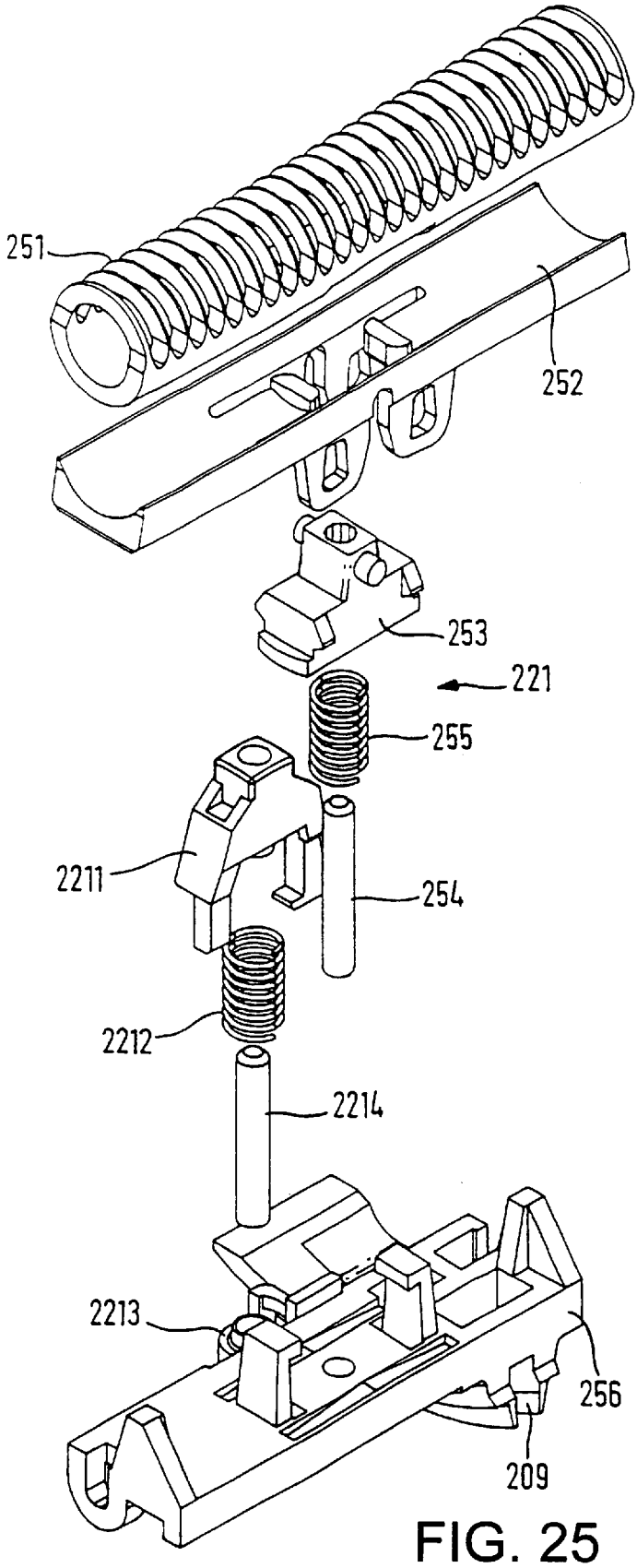
Figure 26:
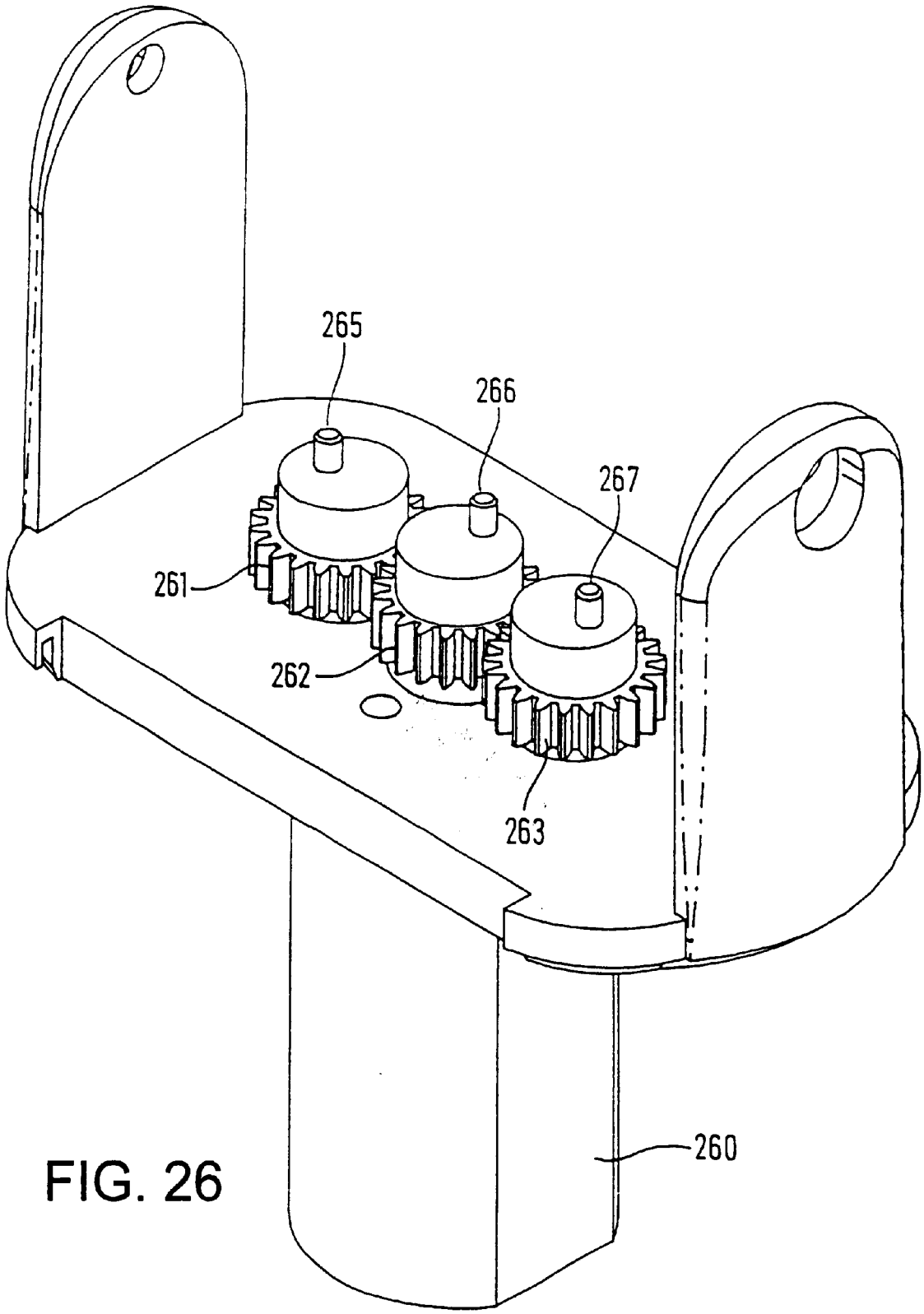
Figure 27:
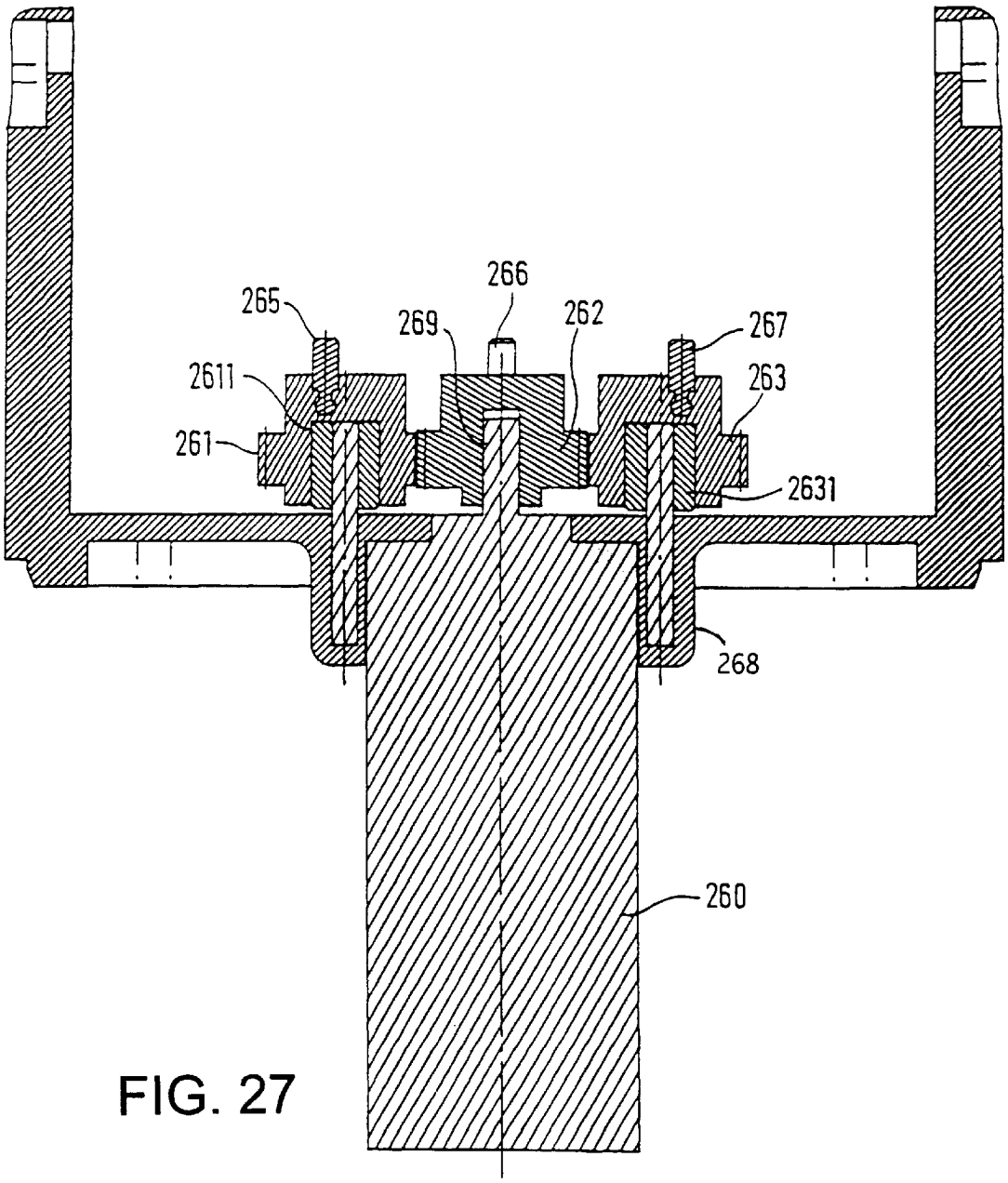
Figure 30:
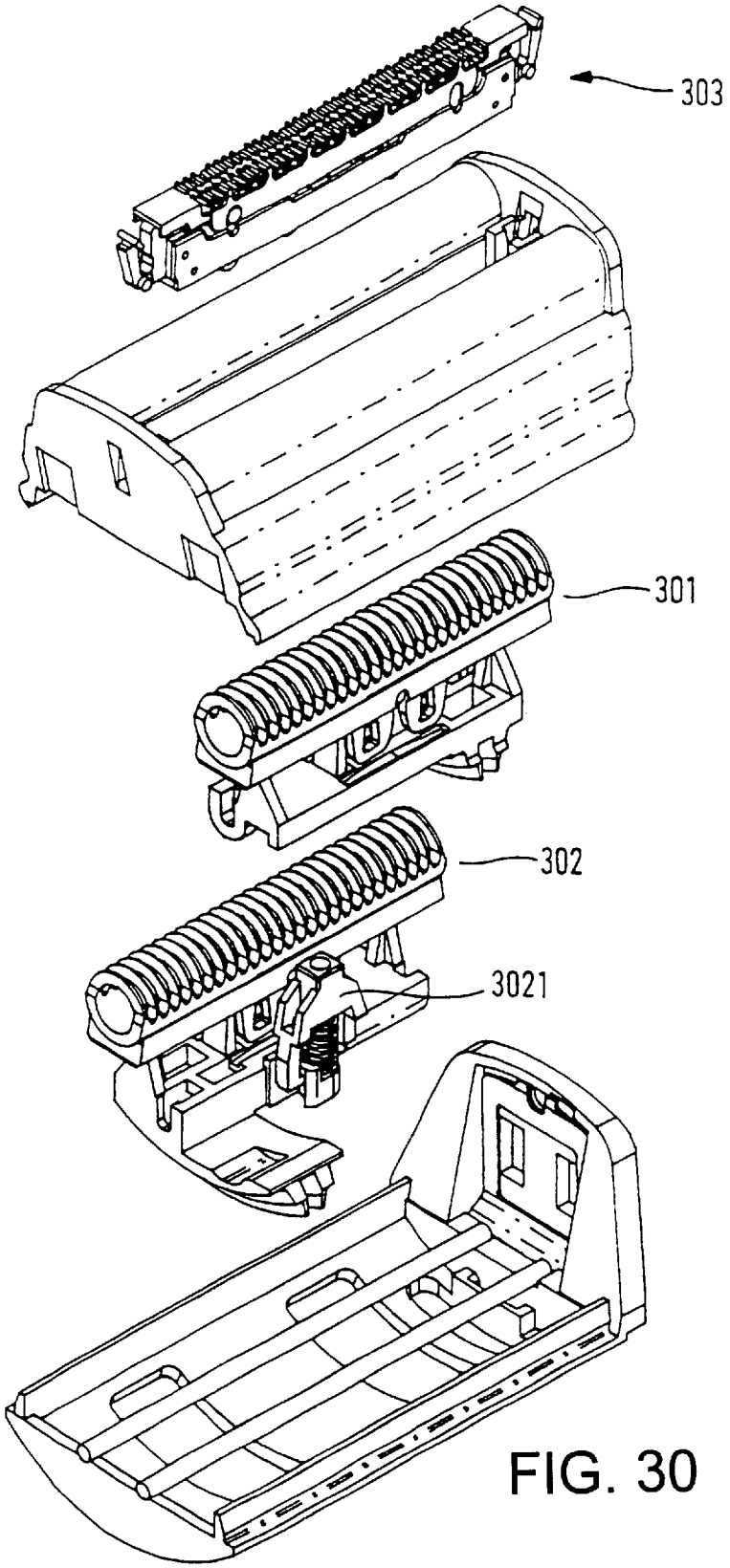
Figure 31:
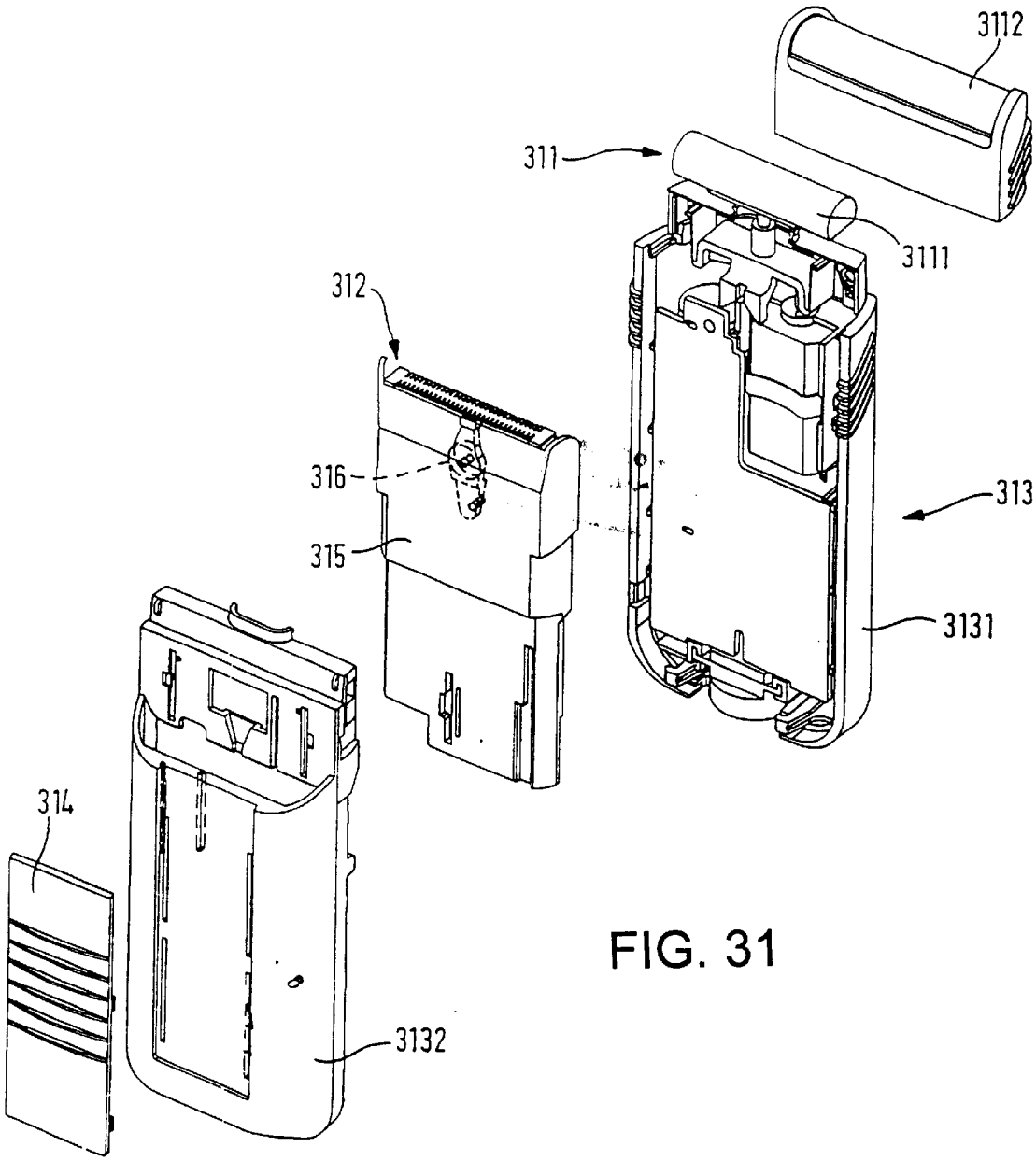
Figure 32:
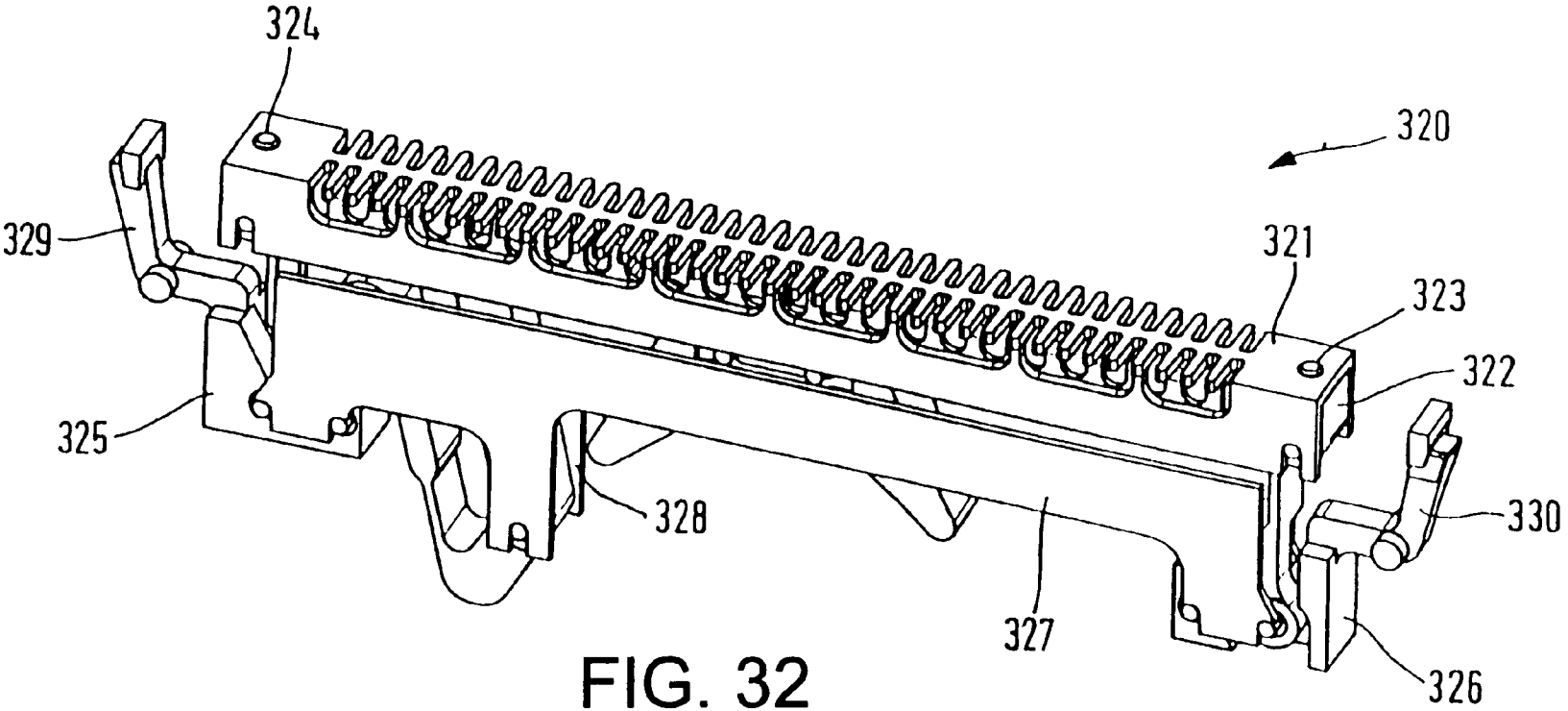
Figure 33:
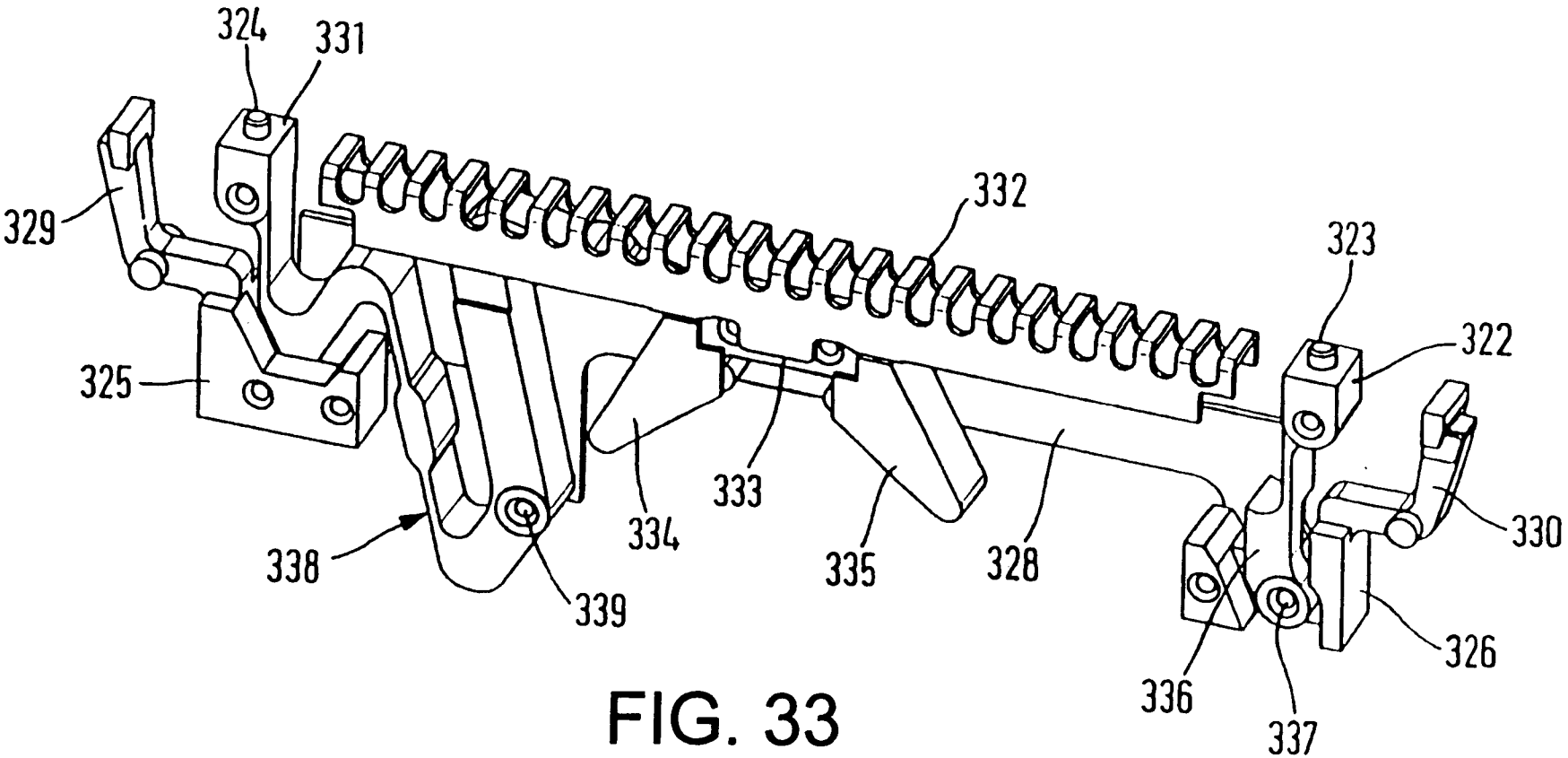
Figure 34:
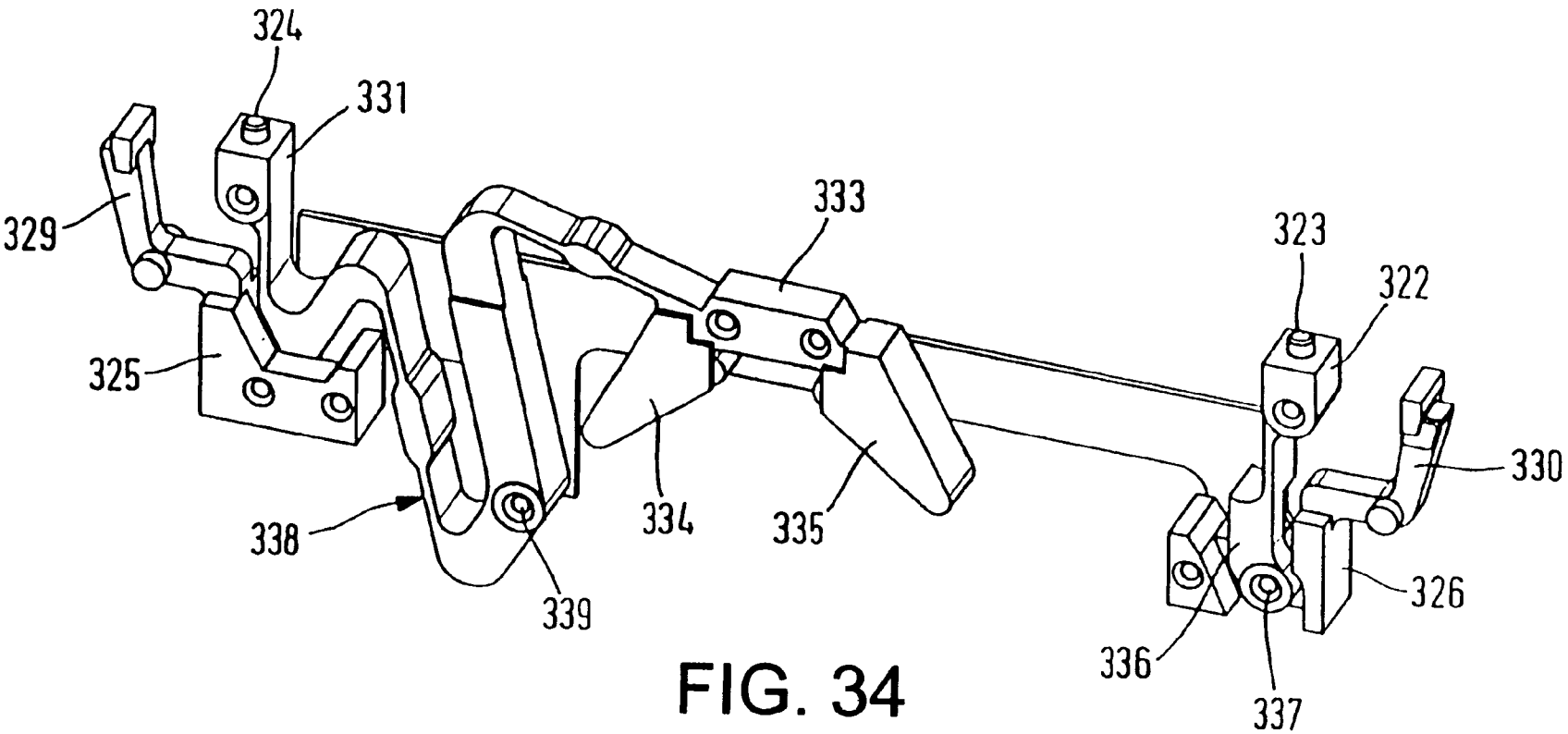
Figure 35:
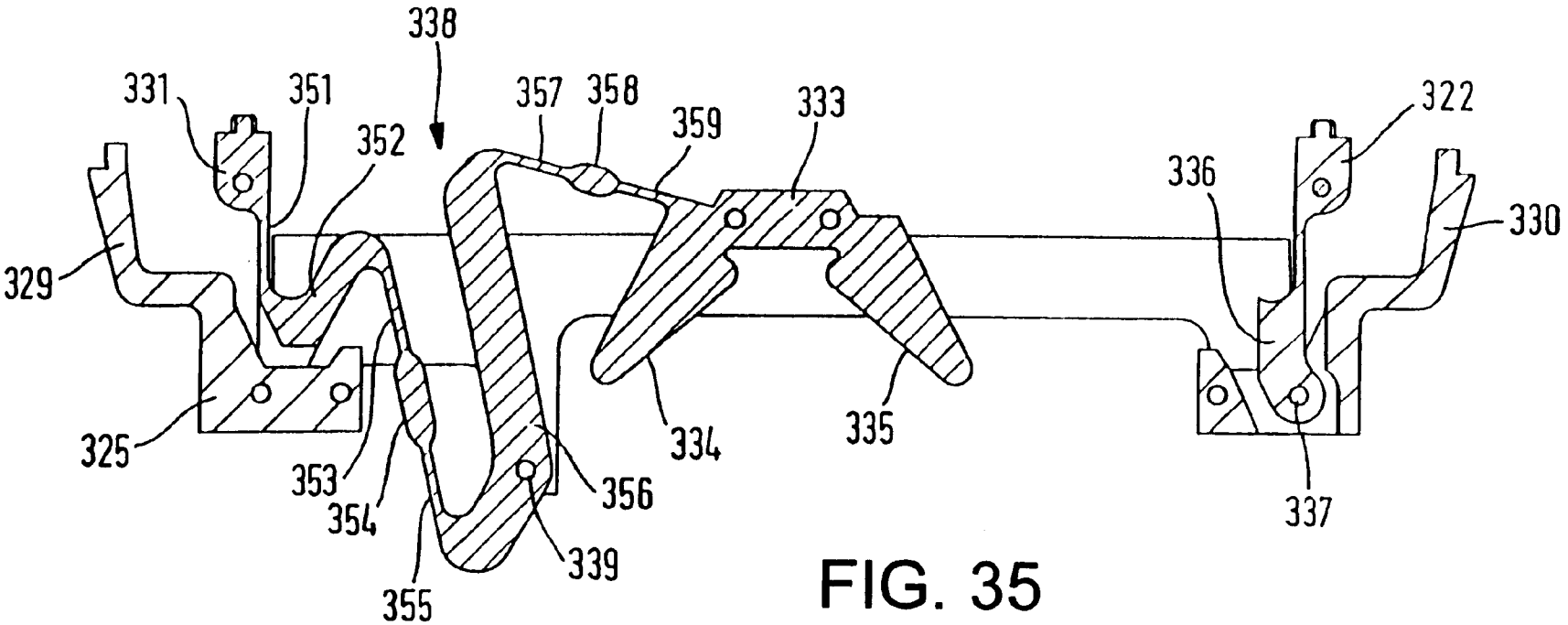
Figure 36:
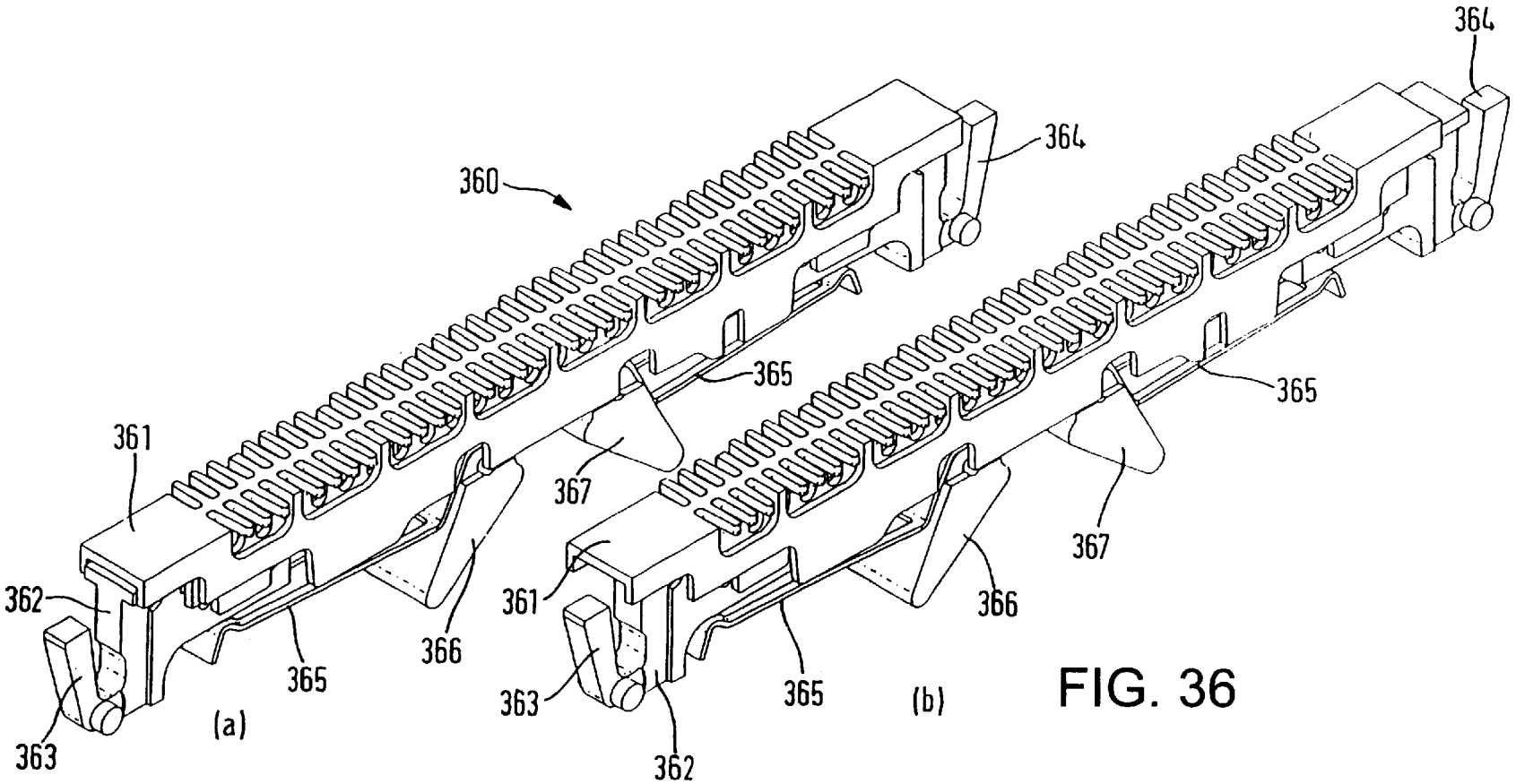
Figure 37:
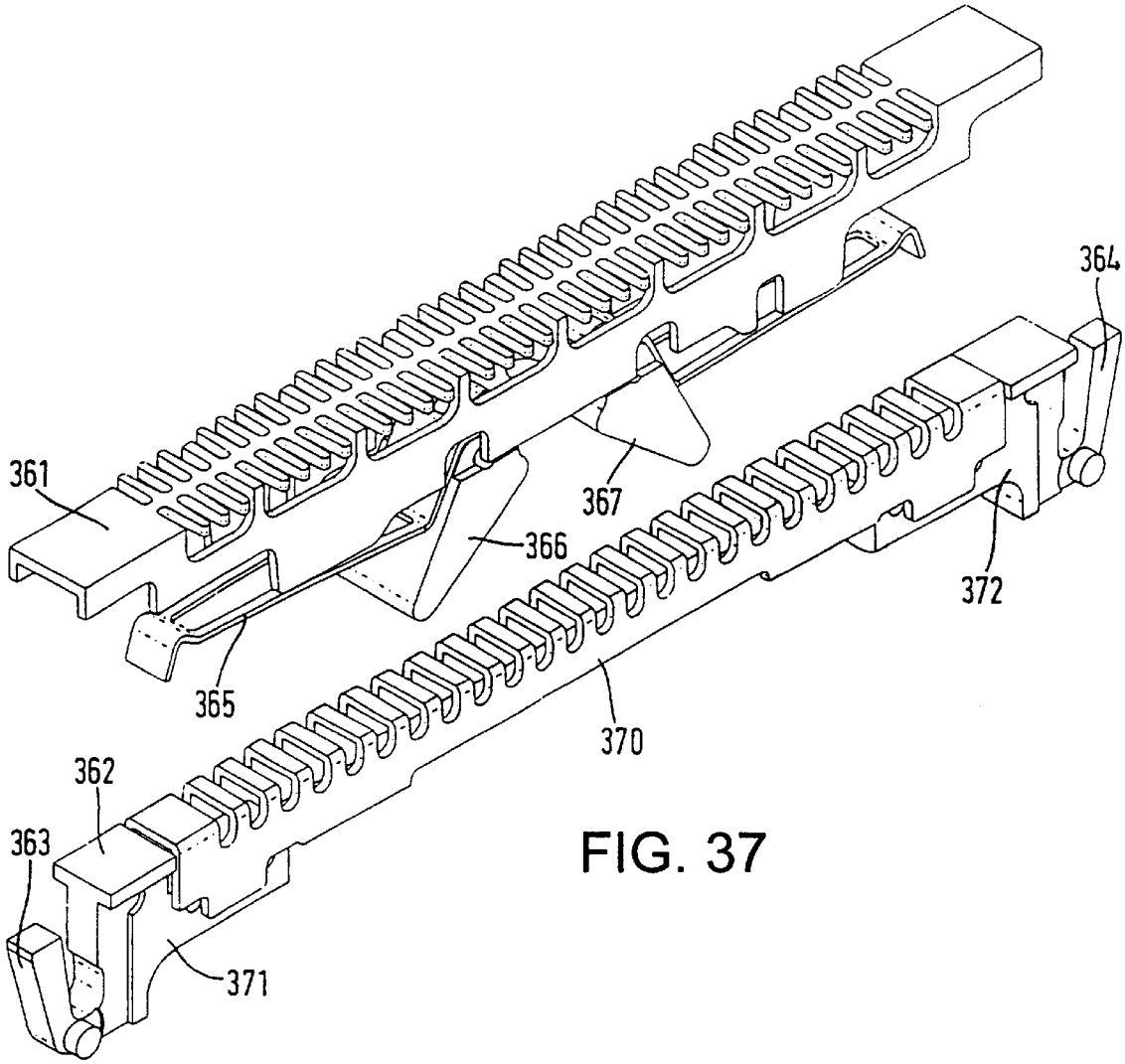
Figure 38:
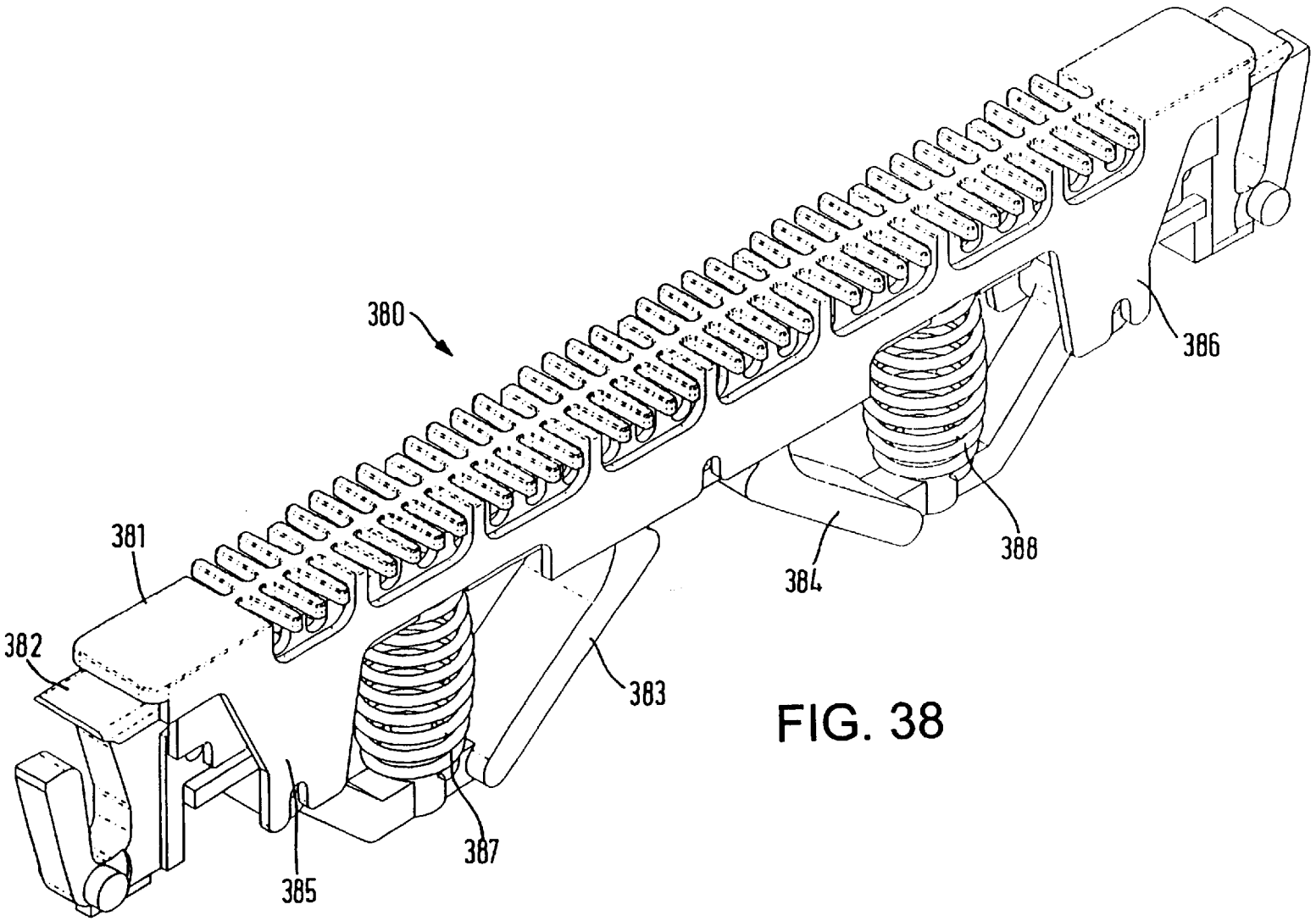
Figure 39:
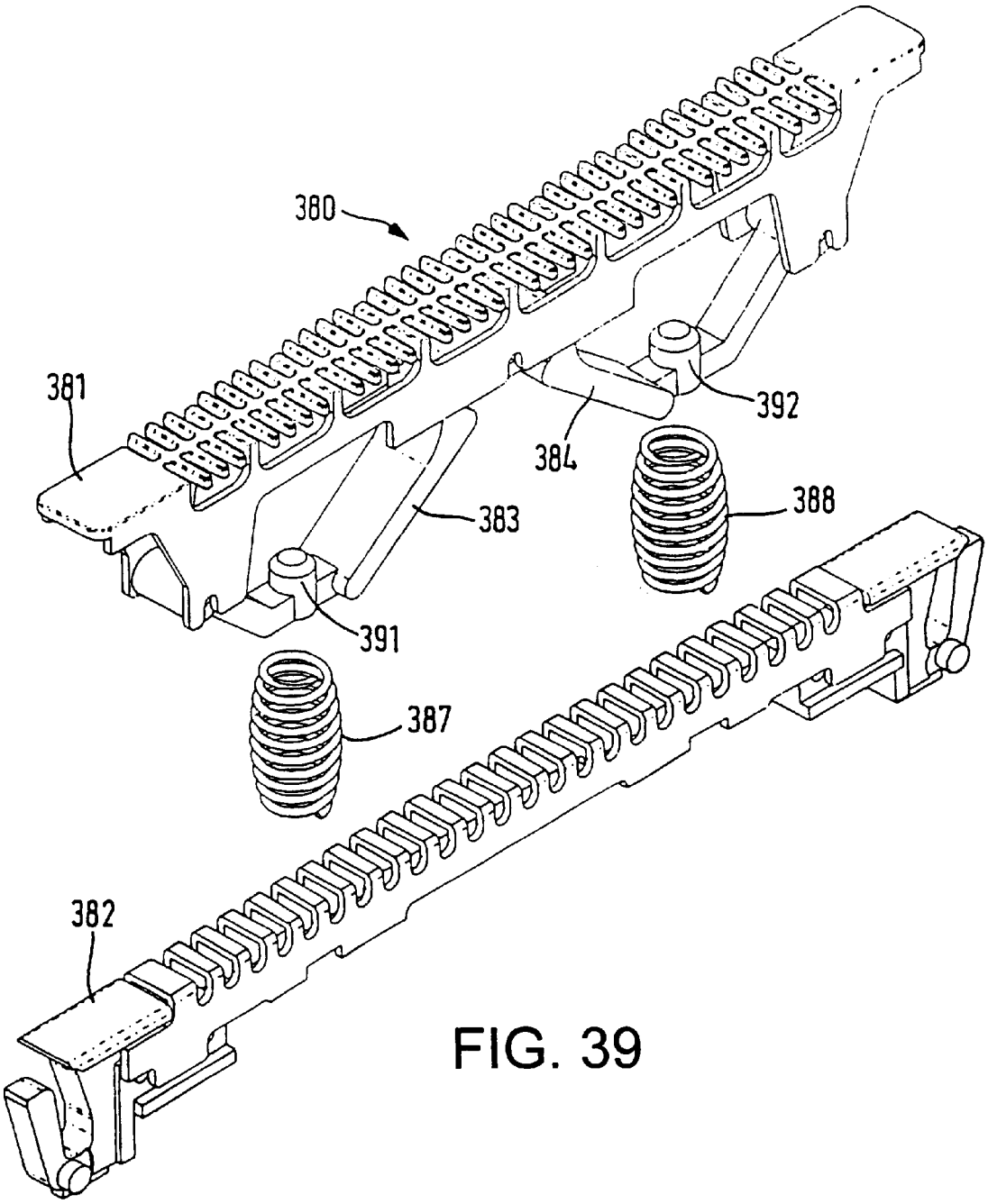

FIG. 7 comprising FIGS. 7*a* and 7*b* shows a third embodiment of active long hair cutter cartridge for implementing option 2, 4 or 7 of FIG. 2;

FIG. 8 shows an exploded isometric view of the long hair cutter cartridge of FIG. 7;

FIG. 8A shows an exploded isometric view of a modification of the long hair cutter cartridge of FIGS. 7 and 8;

FIG. 9 shows a further modification of the active long hair cutter cartridge of FIGS. 7 and 8;

FIG. 10 shows a schematic explanatory diagram relating to the theory of operation of an active skin agitator;

FIG. 11 shows an isometric view, partially cut away, of a shaver head for implementing option 7 of FIG. 2;

FIG. 12 shows a longitudinal sectional view of the assembly of FIG. 11;

FIG. 13 shows a cross-section through the centre line of the embodiment of FIG. 11;

FIG. 14 shows an exploded isometric view of the assembly of FIG. 11 as applied to a swivel-head shaver;

FIG. 14A shows an exploded isometric view of the assembly of FIG. 11 as applied to a fixed-head shaver;

FIG. 15 shows an isometric view of the cartridge of FIGS. 7 and 8 which is used in the assembly of FIG. 14;

FIG. 16 shows a drive member for use in the assembly of FIG. 14;

FIG. 17 shows the undercutter assembly for each of the short hair cutters of the assembly of FIG. 11;

FIG. 18 shows an exploded isometric view of the undercutter assembly of FIG. 17;

FIG. 19 shows a chassis member with guide rails, with an end plate cut away, for use in the assembly of FIGS. 11 and 20;

FIG. 20 shows an isometric assembled view, partially cut away, of dry shaving apparatus for implementing option 6 of FIG. 2;

FIG. 21 is a longitudinal sectional view of the assembly of FIG. 20;

FIG. 22 is a isometric exploded view of the assembly of FIG. 20;

FIG. 23 is an isometric view of the drive system for the central long hair cutter cartridge of FIG. 20;

FIG. 24 is an isometric view of the drive assembly for the undercutter of one short hair unit and also for the undercutter of the central long hair unit;

FIG. 25 is an isometric exploded view of the drive assembly of FIG. 24;

FIG. 26 is an isometric view of a gear box assembly for transferring the drive from an electric motor to the individual cutter units;

FIG. 27 shows a cross-section through the gear box assembly of FIG. 26;

FIG. 28 shows schematically various possible gear and cam pins arrangements;

FIG. 29 shows various possible designs for the long hair unit outer cutter;

FIG. 30 shows an isometric view of a twin drive arrangement including an oscillating long hair cutter unit, which arrangement may be used to implement option 4 of FIG. 2;

FIG. 31 shows an isometric exploded view of a shaver having two shaving units for long hair and short hair respectively;

FIG. 32 shows an isometric view of a fourth embodiment of active long hair cutter cartridge for implementing option 2, 4 or 7 of FIG. 2;

FIG. 33 shows an isometric view of the undercutter assembly of the cartridge of FIG. 32;

FIG. 34 shows an isometric view corresponding to FIG. 33 with the undercutter removed;

FIG. 35 is a side elevational view, partially in section, of the assembly of FIG. 34;

FIG. 36 shows two isometric views of a fifth embodiment of active long hair cutter cartridge for implementing a simplified modification of option 6 of FIG. 2;

FIG. 37 shows an isometric exploded view of the cartridge of FIG. 36;

FIG. 38 shows an isometric view of a sixth embodiment of active long hair cutter cartridge for implementing a simplified modification of option 6 of FIG. 2; and FIG. 39 shows an isometric exploded view of the cartridge of FIG. 38.

FIG. 1 shows a diagrammatic representation of a triple headed dry shaver having three shaving units: two outboard short hair cutter units 1, 2 and a central long hair cutter unit 3, which may be constructed as a trimmer. It has now been proposed that penetration of stubble hairs into the apertures of the long hair unit outer cutter and the short hair unit outer cutters may be improved by imparting an oscillatory motion to the outer cutter of the long hair unit to cause agitation of the skin. FIG. 1 shows various possibilities (a) to (g) which have been investigated for imparting such agitation. As shown, at (a), the outer cutter may oscillate perpendicularly to the skin surface to pummel the face, or (b) parallel to the skin surface and parallel to the direction of oscillation of the undercutters of the short hair units. Alternatively, the outer cutter of the central unit may be caused to perform partial rotation about an axis perpendicular to the skin surface (c) or rocking motion about an axis parallel to the skin surface (d). Moreover, the various possible components of motion may be combined in various ways, for example as shown in the second line of FIG. 1, where options (a) and (c), options (a) and (b), and options (b) and (d) are respectively combined. In the following, a shaving unit in which the outer cutter is moved to agitate the skin will be referred to as an "active unit". Similarly, a movable outer cutter is referred to as an "active cutter", and an outer cutter which is not driven to oscillate is called an "inactive cutter".

In the following, methods of implementing options (b) and (f) will be discussed in more detail.

Referring now to FIG. 2, various ways are possible for driving the individual cutters of a triple headed shaving system. Option 1 shows the arrangement known from WO 93/12916 discussed in the above.

Option 2 can be regarded as a modification of option 1 in which the central long hair unit is modified to impart motion also to the outer cutter. This is achieved by a link member linking the undercutter to the outer cutter, so that the outer cutter moves in anti-phase with the undercutter. This option will be described in more detail hereinafter.

Option 3 has inactive outer cutters in all three shaving units, but drives the undercutter of the long hair unit in phase with the undercutter of one short hair unit, whilst the other undercutter is driven in anti-phase, substantially as shown in DE-A1-43 13 371 (FIG. 13).

Option 4 may be regarded as a modification of option 3, in which motion is also imparted to the outer cutter of the long hair cutter in a similar manner to that used in option 2.

In option 5, all outer cutters are inactive. The undercutters of the short hair cutters are driven in anti-phase, whereas the long hair undercutter is driven 90° out of phase with the undercutters.

Option 6 may be regarded as a modification of option 4, where the long hair cutter is active, with its outer cutter driven 90° out of phase with its undercutter rather than 180° as shown in option 4. Option 6 will be described in more detail hereinafter.

Finally, option 7 introduces a phase shift of 90° between the long hair undercutter and the two short hair undercutters which are driven in anti-phase. The long hair unit outer cutter is driven in anti-phase with its undercutter.

Figure 3:
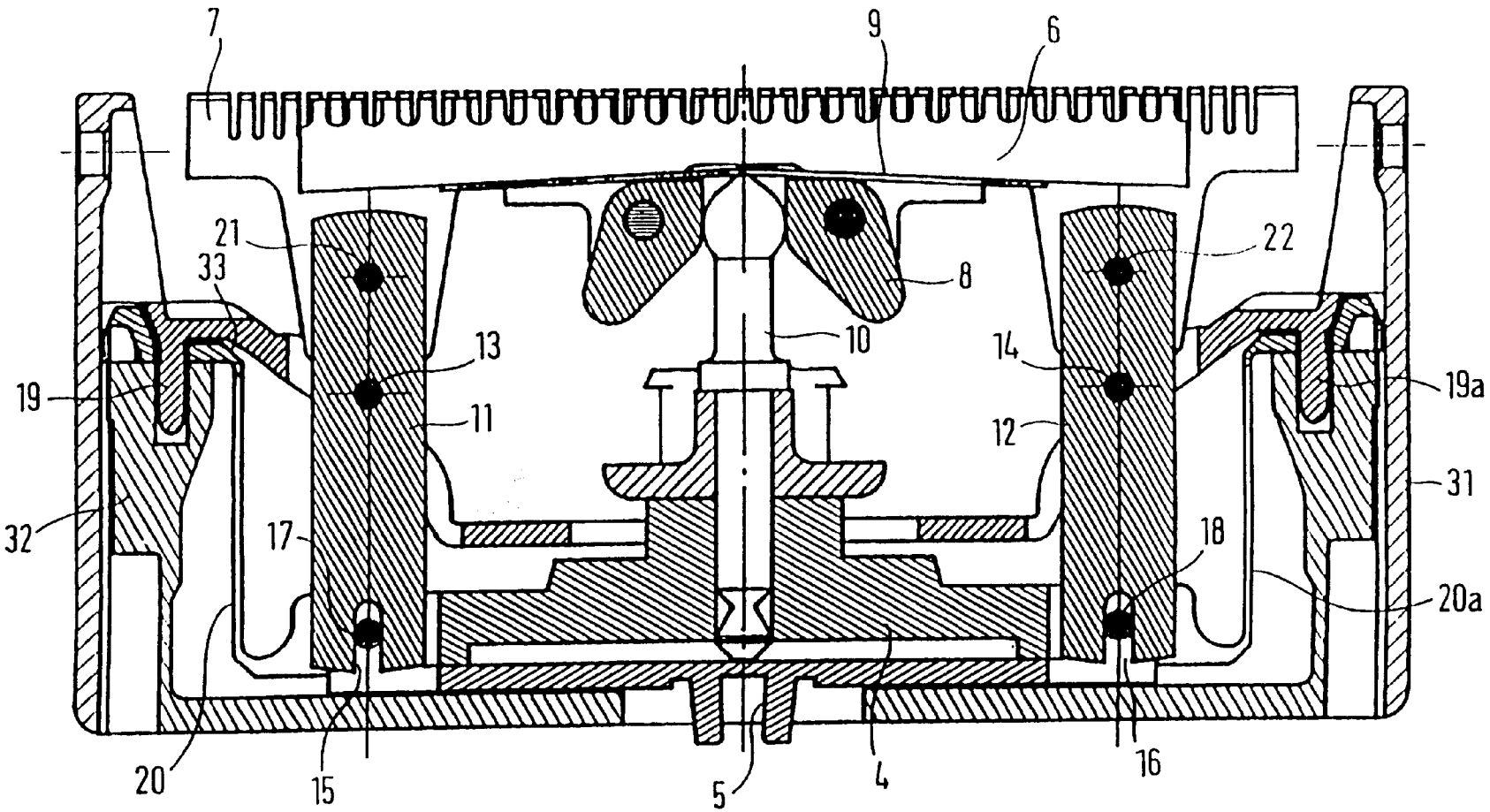
FIG. 3 shows a first embodiment of an active central long hair cutter cartridge for implementing option 2 of FIG. 2.

Consideration has been given as to how the triple-headed designs disclosed in WO 92/12916 could be modified to cause the outer cutter of the central long hair unit to move in any of the ways illustrated, by way of example, in FIG. 1. As a first approach, it is considered that a triple-headed shaver such as shown in WO 92/12916 (represented schematically as option 1 in FIG. 2) could be provided with an active long hair unit cartridge (a cartridge having an active outer cutter) as shown in option 2 of FIG. 2 by making a small modification to the long hair unit. Such a modified long hair unit is shown in FIG. 3.

Within a housing 31 is provided an inner chassis member 32 and an upper chassis member 33 which are snapped together on assembly to trap a drive bridge 4 in position with tongues 19, 19*a*. The drive bridge 4 has flexible parts enabling the bridge 4 to perform oscillatory linear motion. Such motion is imparted to the bridge 4 by a drive pin which is receivable in an aperture 5 at the base of the drive bridge 4. At the upper part of the shaving unit, are provided an undercutter 6 and an outer cutter 7. The undercutter 6 is provided with a coupling element 8 and a bias leaf spring 9 for biasing the undercutter against the outer cutter 7. A link pin 10 engages in the coupling element 8 at one end and is received within the drive bridge 4 at the other end. Pivotally mounted to the chassis member 33 at respective ends of the shaving unit, are link arms 11 and 12. Link arm 11 is pivoted to the chassis 33 by pivot 13 whilst link arm 12 is pivoted to the chassis 33 by pivot 14. Each link arm 11, 12 has a slot 15, 16 at its lower end in which is received a drive pin 17, 18 secured to the drive bridge 4. At the upper end, each link arm 11, 12 is pivotally mounted on the outer cutter 7 by a pin 21, 22 welded to the outer cutter 7. Thus, as the drive bridge 4 is oscillated to and fro, the link arms 11 and 12 cause the outer cutter 7 to move in antiphase with the undercutter 6. During this motion, the link pin 10 remains vertical at all times. The length of the stroke of the outer cutter may be adjusted by adjusting the positioning of the pivot points 13, 14 on the arms 11 and 12.

Figures 4A, 4B:
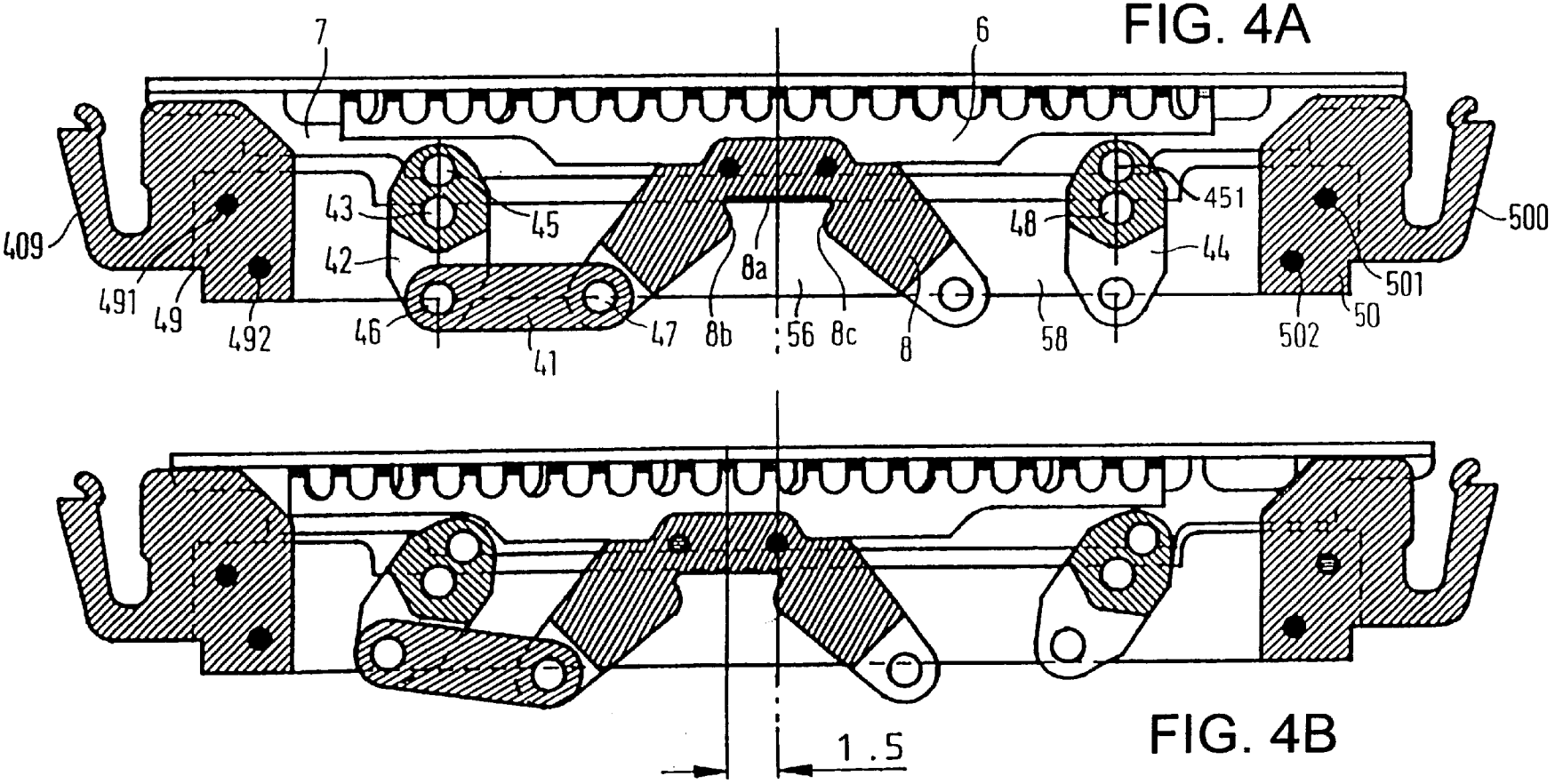
FIG. 4 shows another active long hair cutter cartridge for implementing option 2, 4 or 7 of FIG. 2.

FIG. 4 comprising FIGS. 4*a* and 4*b* shows an alternative construction of long hair cartridge. The cartridge comprises a chassis assembly 56 consisting of two parallel plates 57, 58 secured together by end blocks 49, 50 including integral end latches 409 and 500. Each end block 49, 50 is welded to the side plates 56, 57 by means of pins 491, 492 or 501, 502. This construction allows shorter link arms to be used, as compared with the construction of FIG. 3. Here, the outer cutter 7 is driven directly from the coupling element 8 by means of a crank member 41 and a short arm 42 which is pivoted by a pin 43 welded to the chassis plates 57 and 58. A second pivoted arm 44 is provided at the other end of the shaving unit to retain and ensure parallel movement of the outer cutter. Arms 42 and 44 are pivotally mounted within the chassis assembly 56 by pins 43, 48 which are in turn welded to the chassis assembly. The crank member 41 is pivotably corrected between one limb of coupling element 8 and arm 42 by pins 47 and 46 respectively. The coupling element 8 is welded to the undercutter 6. The upper ends of arms 42, 44 are pivotable on respective pins 45, 451 which are in turn welded to the outer cutter 7. The drive pin (not shown) will engage the coupling element 8 at three points 8*a*, 8*b* and 8*c*. Upward loading is applied through point 8*a* thus imparting both float force and undercutter bias. FIG. 4*a* shows the inner and outer cutters 6 and 7 in a neutral, central position, whereas FIG. 4*b* shows the position adopted when the inner cutter 6 has moved to the left by 1.5 mm and correspondingly the outer cutter 7 has moved to the right by a shorter distance according to the spacing of the pivot points on the link member 42.

Figure 5:
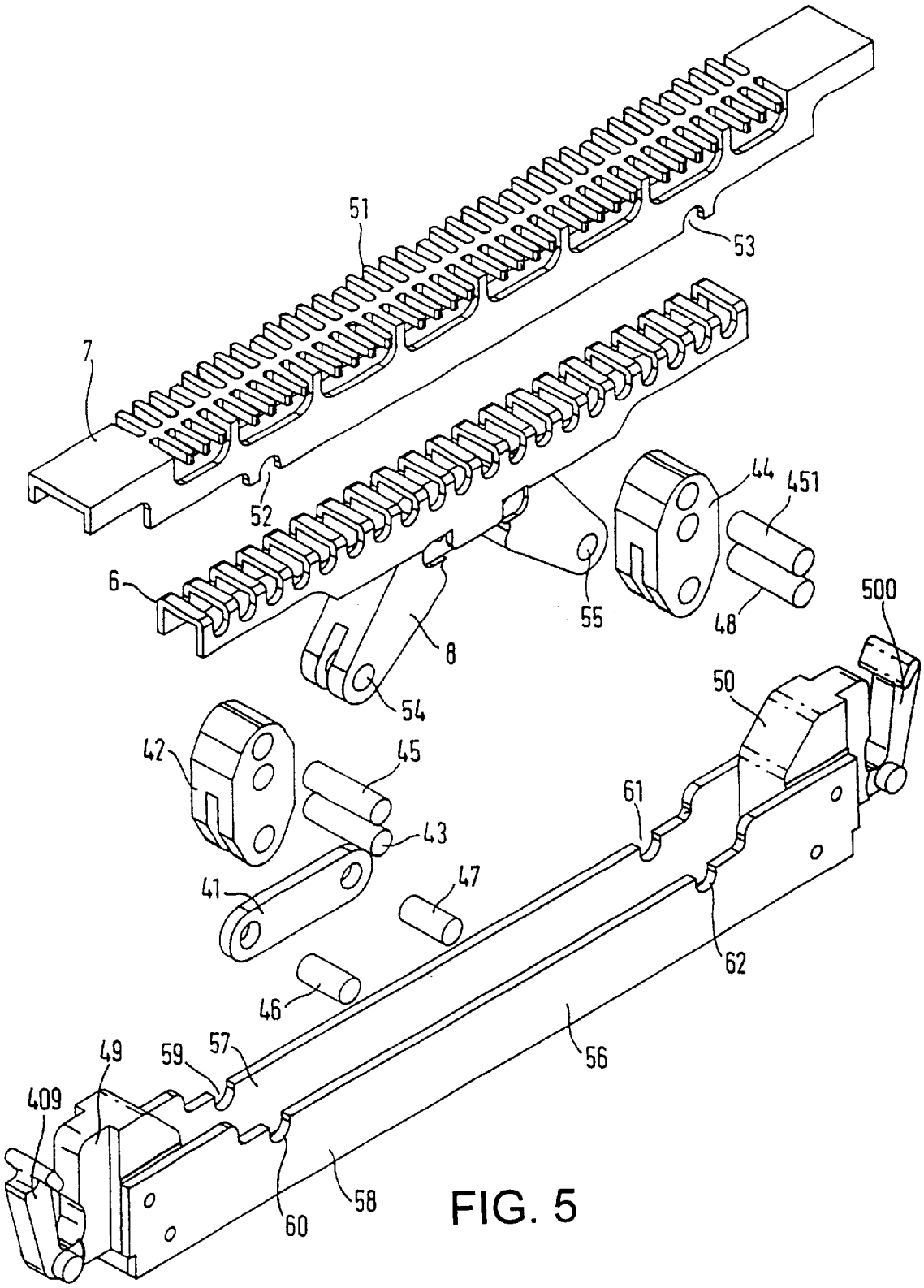
FIG. 5 shows an exploded isometric view of the active long hair cutter cartridge of FIG. 4.

FIG. 5 shows the construction of the shaving unit of FIG. 4 in an exploded isometric view. The outer cutter 7 is of generally U-shaped cross-section and provides a plurality of comb-like teeth 51. On the base of the sidewalls of the outer cutter 7, open-ended slots 52 and 53 are provided for receiving the upper pivot pins 45, 451 of the link members 42 and 44. The undercutter 6 also has a generally U-shaped cross-section. The side walls of the cutter are secured to the coupling element 8 by welding. The coupling member 8 provides two arms, each of which is slotted to receive the crank member 41, although only one crank member is provided as already mentioned. Each arm of the coupling element 8 is provided with an aperture 54, 55 to receive a coupling pin 47 holding the crank member 41 in the slot of the coupling member 8.

The other end of the crank member 41 is received in a similar slot in the lower end of the link arm 42. All the moving parts are carried by the chassis 56 having two side walls 57 and 58, in the upper edges of which semi-circular cut-outs 59, 60, 61 and 62 are provided for receiving the pivot shafts 43, 48 of the respective link arms 42, 44.

Figure 6:
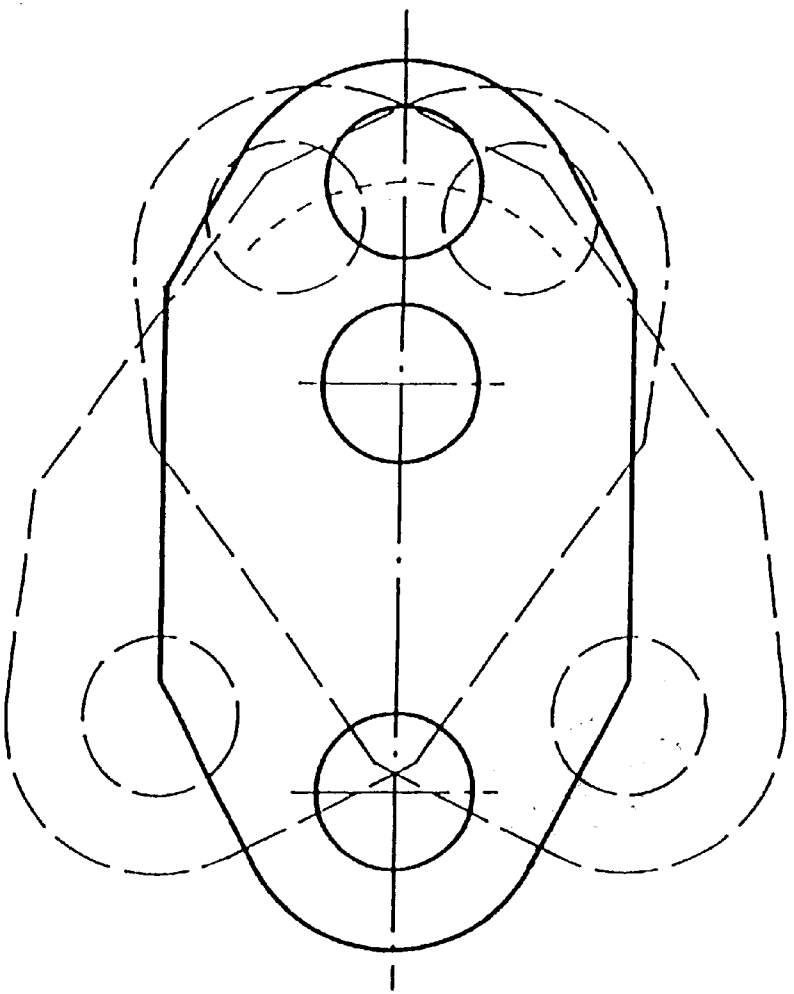
FIG. 6 shows a schematic explanatory diagram.

It will be appreciated that when the outer cutter 7 is driven in the manner shown in FIGS. 4 and 5, or to a lesser extent when driven in the manner shown in FIG. 3, its point of attachment to the vertical pivot arms 42, 44 or 11, 12 moves on an arcuate path. Accordingly, not only does the outer cutter move horizontally to and fro, but also it moves up and down in a vertical direction, as illustrated schematically in FIG. 6. As shown, with the geometry of the cartridge illustrated in FIGS. 4 and 5, the amount of vertical travel is 0.17 mm where the horizontal travel of the undercutter is 2.60 mm, rises to 0.24 mm of vertical travel where the horizontal travel of the undercutter is 3.00 mm and rises to 0.36 mm of vertical travel where the horizontal travel of the undercutter is 3.60 mm. This degree of vertical travel enables a so-called "pulsing effect" to be produced on the user's skin, as shown in option (f) of FIG. 1. With the arrangement of FIG. 3 the pulsing effect is quite small, but may be excessive for comfort with the arrangement of FIG. 4.

If it is desired to avoid this pulsing effect, the construction shown in FIG. 7 and 8 may be employed. The construction of FIG. 7, including FIGS. 7*a* and 7*b*, is similar to that shown in FIG. 4, with the exception that the upper pivot of the link arms 42 and 44 is achieved differently to allow a degree of vertical displacement between the vertical link arms and the outer cutter. In the embodiment of FIG. 4, the pivot pin 45 is pivotable within the upper aperture of the link arm 42 and is secured, e.g. by welding, in the U-shaped cut-outs 52 of the outer cutter 7. But in the embodiment of FIG. 7, as best shown in FIG. 8, the vertical link member 42*a* has integral bosses 45*a*, 45*b* at its upper end which are received slidably in a U-shaped slot 52*a* on outer cutter 7. Integral slides 81, 82 in the outer cutter 7 run in slots 83, 84 in the end blocks 49, 50 of the chassis assembly 56 to guide and retain the outer cutter 7. Otherwise, the construction of FIGS. 7 and 8 is substantially identical to that shown in FIGS. 4 and 5.

FIG. 8A shows a modification of the cartridge of FIGS. 7 and 8 in which the outer cutter 7A has comb-like teeth along one edge only. The undercutter 6*a* is designed in a similar way.

FIG. 9 is a further modification of the embodiment of FIGS. 7 and 8 in which the pivot links between the central coupling member 8, the crank member 41 and the vertical link arm 42*a* are achieved by film hinges 91 and 92. This has the advantage of simplifying fabrication, since the arms, coupling element and crank member can be manufactured as a single moulded unit.

If any of the embodiments of active long hair cutter cartridge described with reference of FIGS. 3 to 9 are employed as the central long hair cutter in a triple headed shaver such as known from WO 92/12916, thus producing option 2 according to FIG. 2, a situation is achieved in which all the undercutters continue to oscillate in phase and in synchronism, whereas the outer cutter of the central long hair unit oscillates in antiphase. Although this achieves some beneficial effect in promoting hair penetration through the apertures of the outer cutters, it can be shown on the basis of theoretical considerations, and is also confirmed by practical tests, that a phase relationship of 180° is not optimal. This may be explained on the basis of FIG. 10. FIG. 10(*a*) shows schematically a plan view of a triple-headed shaver where the undercutters of the two short hair units are moving to the left, whereas the outer cutter of the controlling long hair cutter moves to the right. FIG. 10(*b*) shows the effect which this has on hairs being cut by the short hair units on either side of the long hair unit. As a consequence of the motion of the outer cutter section of the long hair cutter, a hair 101 is pressed against the right hand side of an aperture in the outer cutter of one of the short hair units. As this occurs, the undercutters will be moving to the left and accordingly will push the hair away from the side of the aperture, so that the shearing effect is not very efficient, and the cut hairs are relatively long.

Consider now the situation as shown in FIG. 10(*c*), where the outer cutter of the central long hair unit moves in phase with the undercutters of the two short hair units. Here, when the hair 101 is pressed against the left-hand side of an aperture in the outer cutter of one of the short hair units, the corresponding undercutter is moving to the left and accordingly an effective shearing action takes place, and the cut hair is relatively short. This corresponds effectively to option 4 of FIG. 2 (except that in option 4 one of the short hair unit undercutters is driven in antiphase with the outer cutter of the long hair cutter).

Although good results may be expected when the long hair unit outer cutter is driven in synchronism and phase with the short hair undercutters, even better results may be achieved where the long hair outer cutter leads the trailing short hair undercutter by a phase angle of 90°. In fact, it may be stated that any phase angle in the range 0° to 120° will be effective, although substantially 90° is preferred.

Ways in which a phase angle of 90° may be achieved, as shown in options 6 and 7 of FIG. 2, will be discussed in detail hereinafter, with reference to FIGS. 11 to 26. In these embodiments, the application of the invention to a triple-headed shaver is described. Here it is possible to adjust the phasing of both short hair units to lag the outer cutter of the central long hair cutter by 90°. However, it is also possible to arrange for only the trailing short hair unit to lag the central unit outer cutter by 90°. The other short hair unit may either lead the outer cutter of the central unit by 90° (option 7) or be in antiphase therewith (option 6) or have any other selectable phase if appropriate linkages are provided.

Alternatively, it is also within the scope of the invention to drive the outer cutter of the long hair unit at a lower or higher frequency than that of the short hair units, so that the phase relationship between the outer cutter of the long hair unit and the undercutters of the short hair unit varies cyclically. Such an arrangement is particularly of value if it is desired to avoid a preferential direction in use, since either short hair unit can then be regarded as the trailing unit.

Referring now to FIG. 11, this shows a construction which corresponds to option 7 of FIG. 2, with one end plate being cut away for improved clarity. In FIG. 11, a swivel head frame for a triple-headed shaver arrangement is illustrated in which a central long hair unit 111 is in the form of a cartridge corresponding to that shown in FIGS. 7 and 8. The short hair units 112 and 113 are shown with the outer perforate cutter (sometimes called the foil) removed. FIG. 11 thus shows the central long hair unit 111 positioned between two adjacent short hair units 112 and 113. In this embodiment, all three undercutters are independently driven and the drive for the long hair outer cutter is taken from the long hair undercutter by means of a link or drive arm as already described with reference to FIGS. 7 and 8. This means that the active unit 111 can be driven at a different speed from units 112 and 113 and that the phase angle between the active outer cutter and the short hair undercutters can be set for optimum performance.

FIG. 12 is a longitudinal sectional view of the assembly of FIG. 11 with both end plates 121 and 122 in place. Also visible is a coil spring 132 for providing upward bias to the long hair undercutter. At the base of the assembly may be seen three drive slots 124, 125 and 126 for receiving respective drive pins (not illustrated) for driving the respective cutter units, as will be better understood from FIG. 14. Each end plate 121, 122 provides a bearing aperture 1211, 1221 for receiving an axle stub to permit the head to swivel.

FIG. 13 shows a cross-section taken along a vertical central plane through the assembly of FIG. 11. It shows clearly the bias springs 123, 131 and 132 for the respective shaving units. The Figure also shows two guide rods 133 and 134 for modules 142, 143 and 144, as will be explained further with reference to FIG. 14. The rods 133 and 134 are received in U-shaped channels 114 and 115 in the short hair modules, and similar channels in the long hair module.

Referring now to FIG. 14, the assembly of the shaving system of FIG. 11 will be understood more clearly. As shown, the assembly is built up from six separate modules: an active long hair cartridge module 141, an active cartridge drive module 142, a first short hair undercutter module 143, a second short hair undercutter module 144 (identical to the first 143), a chassis module 145, shown with one end plate cut away, and a foil frame assembly 146, which comprises two short hair unit outer cutters 1462, 1463 mounted in a frame 1461 such that the outer cutters can move vertically but not axially. Chassis module 145 is arranged to pivot about two axle stubs (not shown) which engage in the bearing apertures in the respective end plates. One such bearing aperture 1221 is shown in end plate 122.

The long hair module 141 is identical with that already described with reference to FIGS. 7 and 8, and so will not be described further. An enlarge isometric view of the same cartridge is shown in FIG. 15.

The drive module 142, best shown in FIG. 16, consists of a generally rectangular slider frame 146 having a central cross member 147 which serves both to support a spring assembly 148 (including coil spring 132) and drive post 149 on its upper side and to provide an arcuate drive slot 125, for receiving a drive pin, on its lower side. Apertures 1421, 1423 and 1422, 1424 receive the drive rods 133, 134 for linear axial guidance of the module 142.

Drive post 149 slides vertically over a drive pin and is retained on it by a retainer 1425. The spring 132 supplies the vertical force between the slider 142 and the drive post 149 to ensure both the correct contact between the undercutter and outer cutter of the active unit, and the correct float force for the active unit.

Each of the undercutter modules 143 and 144 is identical. One of the modules is shown at an enlarged scale in FIG. 17 and in an exploded isometric view in FIG. 18, to which reference will now be directed. The module includes a generally tubular cutter 181 provided with a plurality of transverse slots 1811 to provide a plurality of arcuate blades 1812 which co-operate in a shearing action with the corresponding outer cutter (or foil) during shaving. The cutter 181 is mounted on a support 182 and held in place by two posts 1821 and 1822. At one edge of the lower side of the support 182 is provided a pair of lugs 1823 and 1824. A corresponding pair of lugs are provided on the other edge of the lower side. Apertures in the lugs 1823, 1824 snap over, and are loosely retained on, respective latch members 1836, 1837. Between each pair of lugs is defined a bearing surface, e.g. 1825, for receiving a bearing pin 1831, 1832 of a bearing block 183. Drive is transmitted to the undercutter from the bearing block 183 by means of the pins 1831, 1832, on which the support 182 can rotate and move laterally to ensure good cutter contact with the foil outer cutter.

A guide hole 1833 passes vertically through the block 183, for slidably receiving a link pin 185. A coil spring 184 surrounds the pin 184 and applies an upward biasing force against the lower surface of the bearing block 183. The lower end of the link pin 185 is rigidly secured in an aperture 1861 in a base support 186, which also provides a pair of upstanding gripping arms 1862 and 1863 for receiving respective lateral retaining jugs 1834 and 1835 of the bearing block 183. On its lower surface, the base member 186 provides the arcuate slot 124 for receiving a drive pin which imparts the necessary oscillatory motion to the undercutter. A hole 1865, and a corresponding hole 1867 at the other end of the base member 186, receive the guide rod 134 for guiding the member 186 in the axial direction.

A peg 1866 rests against the bottom of the other rod 133 and prevents rotation of the member 186 about the rod 134 in one direction.

The chassis module 145 is shown in FIG. 19, with one end plate cut away. The module, which is capable of swivelling about a longitudinal axis, consists of an arcuate base plate 191 in which three substantially rectangular apertures 192, 193 and 194 are provided for allowing access to the three drive slots 124, 125 and 126 of the respective cutter units 111, 112, 113. Extending longitudinally of the module and supported by the base plate 191 are provided two guide rods 133 and 134 for linear guidance of the three modules 142, 143 and 144. As already described, each undercutter module 142, 143, 144 comprises guide apertures 1865, 1867, 1421, 1422, 1423 and 1424 which engage with a respective one of the guide rods 133, 134 to ensure accurate linear guidance of the respective undercutter. The rods 133, 134 are retained by clips (not shown).

FIG. 14A shows an alternative assembly for use in a fixed head shaver. The modules 141–144 and 146 are identical to those in FIG. 14. Module 145A differs from module 145 by being mounted fixedly to the upper end of the shaver housing so that it cannot swivel.

Reference will now be made to FIGS. 20 to 25 which show how option 6 of FIG. 2 may be implemented. In this embodiment, there is a phase shift of 90° (rather than 180°) between the long hair outer cutter and its undercutter, so that the technique of driving the outer cutter from the undercutter using a drive linkage as shown in the embodiments of FIGS.

3 to 9 cannot be used. Instead, the outer cutter is driven by a separate linkage, so that, if desired, the drive to the outer cutter could be disabled (e.g. by a switch) without affecting drive to the undercutter. Moreover, any desired phase relationship between the outer cutter and undercutter may be selected. Furthermore, the undercutter may even be static.

Referring now to FIG. 20 in more detail, the illustrated triple-headed dry shaver 200 comprises three shaving units 201, 202 and 203. Two of the units 201 and 203 are constructed as short hair cutters. For these units, only the undercutters 2011, 2031 are shown. Outer perforate cutters, e.g. foils, of substantially conventional construction may be used to complete the short hair units. The third unit 202 is constructed as a long hair cutter in the form of an active cartridge. FIG. 21 is a longitudinal sectional view of the assembly of FIG. 20, with both side plates 204 and 205 present. Bias spring 206 for the active cartridge is visible. At the base of the assembly, three slots 207, 208 and 209, for receiving respective drive pins, are accessible through three apertures in the base plate 210.

FIG. 21 shows the slider assembly for the oscillating long hair unit 202 comprising the long hair cutter slider frame 2223, outer cutter 214, undercutter 215 and coupling latches 211 and 212. The outer cutter 214 is welded to the latches 211, 212 which in turn are fitted into the slider frame 2223 in such manner that they can move vertically but not axially. The coupling element is welded to the undercutter 215 and is retained beneath the outer cutter. A leaf spring 213 provides a force to bias the undercutter 215 against the outer cutter 214. The coil spring 206 provides float force for the unit 202.

FIG. 22 shows how the assembly 200 of FIG. 20 is made up from five modules 221, 222, 223, 224 and 225. Undercutter module 221 differs from the other undercutter module 223 in that it includes an extra drive member 2211 for transmitting drive to the undercutter of the long hair unit 202. The drive member 2211 is floatingly mounted on a coil spring 2211 to provide float pressure for the long hair cartridge 202. Otherwise, the undercutter module 221 is the same as the undercutter module illustrated in FIG. 17, so that further description may be omitted.

Module 222 includes a drive system for the outer cutter of the long hair cutter unit, and also carries the long hair unit cartridge, which engages by snap fit in two receiving latches 2221 and 2222 at respective ends of the module. The module comprises a generally rectangular frame 2223 having a cross-member 2224 at its centre. The slot 208 is provided on the lower side of the cross-member 2224 for receiving a drive pin to cause the outer cutter to oscillate.

Undercutter module 223 is identical with module 144 of FIG. 17, so that further description of this module may be omitted.

The assembly is carried on the chassis module 224, which is identical with module 145 of FIG. 19, so that further description of this module may be omitted.

The foil frame assembly 225 comprises two outer cutters 2251, 2252 for the short hair units mounted in a frame 2253, to permit vertical, but not axial, outer cutter movement.

An enlarged view of the drive system and long hair cutter module is shown in FIG. 23, and an enlarged view of the first undercutter module 221 is shown in FIG. 24.

FIG. 25 represents an exploded isometric view of the first undercutter module 221. The module comprises a tubular cutter 251, a cutter support 252, a bearing block 253, a link pin 254 and a coil spring 255 which are identical to the corresponding items of FIG. 18, so that further detailed description may be omitted. The base support 256 differs from that of FIG. 18 by the presence of a carrying lug 2213 having a circular bore therein for receiving a further link pin 2214. Pin 2214 carries the coil spring 2212 which applies bias force to the drive member 2211 for the long hair undercutter. This provides good contact between the undercutter and outer cutter and also provides the desired float force.

FIG. 26 shows a gear box which is able to be configured in various ways to provide adjustable phase relationships and frequency ratios to the individual driven units of the shaving system. The gear box comprises three parallel vertical shafts arranged in line, one of which, normally the central shaft, is directly coupled to the armature shaft of a rotary electric motor 260 as drive source. In the particular illustrated configuration, the gear box comprises three gears 261, 262 and 263 on respective shafts. Each gear also carries an offset cam pin 265, 266, 267 for engagement in a respective one of the drive slots at the base of the respective shaving units described in detail in the above, e.g. slots 124, 125 and 126 of FIG. 12 or slots 207, 208 and 209 of FIG. 21. Thus the moving components of the respective shaving units are caused to reciprocate in the manner of a Scotch yoke.

In the illustrated embodiment, all gears 261, 262 and 263 are the same size, so that cam pin 267 and pins 265 and 266 will rotate at the same speed. Gear 262 could be replaced with a smaller gear so that both the outboard shafts would rotate at the same rate, but slower than the central shaft.

Alternatively, a large gear could be used on the central shaft in mesh with two smaller gears on the outboard shafts to cause the two outboard shafts to rotate faster than the central shaft.

Phasing relationships between respective shafts can be adjusted simply by adjusting the circumferential position of the respective drive pins 265, 266 or 267, or removing the associated gear and replacing it a new circumferential position rotated from its previous position.

FIG. 27 shows the motor 260 secured to a frame 268. Gears 261 and 263 have bearings 2611 and 2631 respectively pressed into them. Gear 262 is secured to the motor shaft 269 so that it can rotate therewith. Pin 266 is pressed into gear 262.

Referring now to FIG. 28, this contains six possible arrangements (a) to (f) for the gearing and phasing arrangements of the cam pins. FIG. 28*a* shows all gears with the same ratios such that the cam pins stay in the same phasing. As shown, the two outer cam pins drive the short hair undercutters in antiphase. The drive offset for each is the same.

Figure 28A:
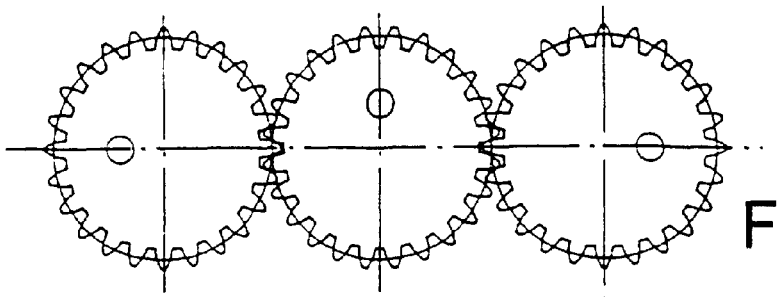
Figure 28B:
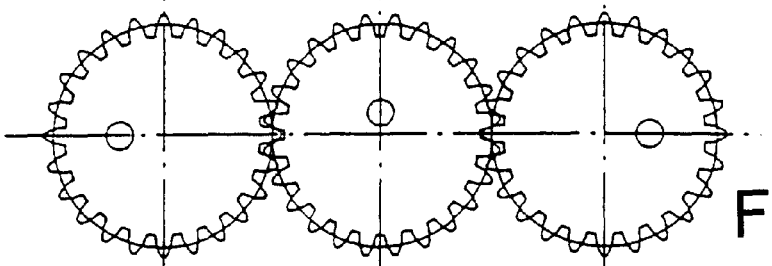

FIG. 28*b* shows all gears with the same ratio, such that the cam pins stay in the same phasing. As shown, the two outer cam pins drive the short hair undercutters in antiphase. The drive offset for each of the short hair undercutters is the same. However, the middle drive provides a shorter throw.

Figure 28C:
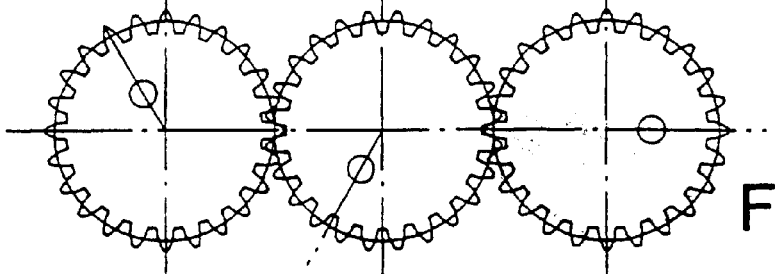

FIG. 28*c* shows all gears with the same ratios such that the cam pins stay in the same phasing. As shown, the three cam pins are all 120° out of phase to each other. The drive offset for each is the same.

Figure 28D:
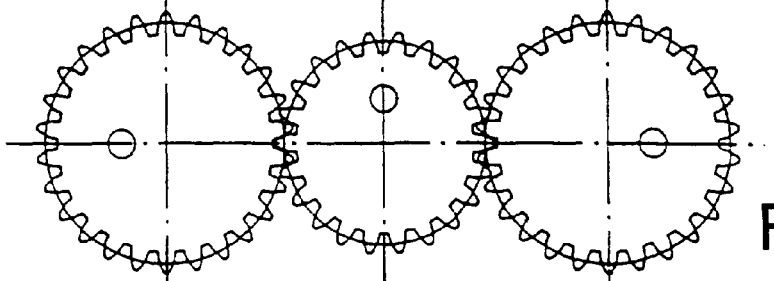

FIG. 28*d* shows the two outer gears (whose cam pins drive the short hair undercutters) with the same ratio such that the cam pins stay in the same phasing. As shown, the two outer cam pins drive in antiphase to each other. The central gear is smaller than the other two and hence its drive pin will rotate faster than the other two to give a constantly changing phase angle. As shown, the drive offset for each is the same. However, the offset of the centre drive could be made either greater or smaller than the others.

Figure 28E:
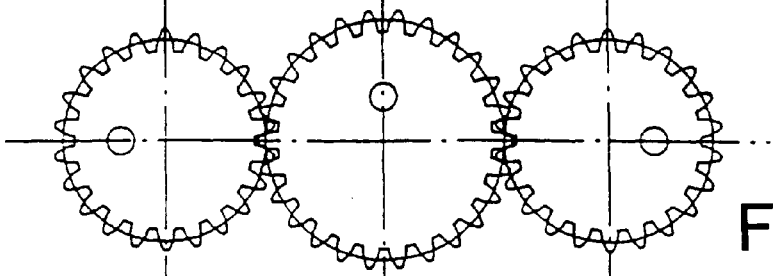

FIG. 28*e* shows the outer two gears whose cam pins drive the short hair undercutters with the same ratio, such that the cam pins stay in the same phase. As shown, the two outer cam pins drive in antiphase. The central gear is larger than the other two and hence its drive pin will rotate more slowly than the other two to give a constantly changing phase angle. As shown, the drive offset for each is the same. However, the offset of the centre drive could be made greater or smaller than the others.

Figure 28F:
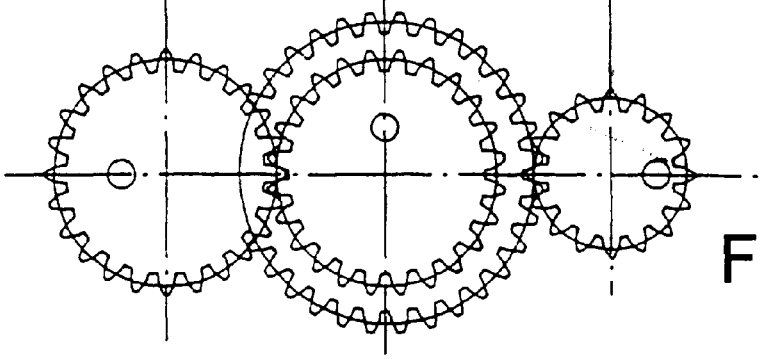

FIG. 28*f* shows an alternative gear box arrangement, in which two separate gears, of differing size, are provided on the motor shaft. Each of the outboard gears is in mesh with the respective one of the gears on the motor shaft. This of course has the consequence that the two outboard shafts rotate at differing speed.

Referring now to FIG. 29, various possible designs for the long hair unit outer cutter are shown.

Figures 29A, 29B, 29C, 29D, 29E:
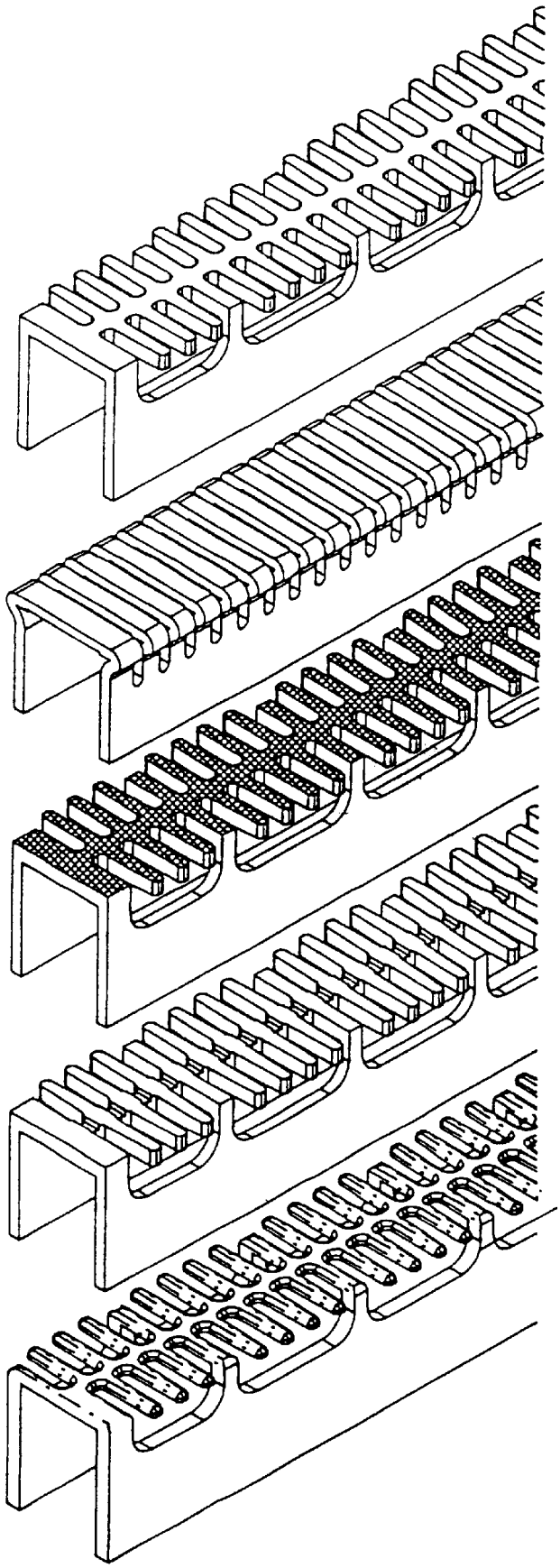

FIG. 29*a* shows the outer cutter provided with outwardly projecting teeth and a solid centre bar.

FIG. 29*b* shows an outer cutter having rounded projecting edges but no solid centre bar.

FIG. 29*c* represents a long hair unit outer cutter corresponding to that shown in FIG. 29*a* but modified to have its surface textured (e.g. by sand blasting) to improve grip and change its appearance.

FIG. 29*d* shows a long hair unit outer cutter with outwardly projecting teeth and a solid centre bar which has been partially relieved to enhance the gripping effect.

FIG. 29*e* shows a long hair unit outer cutter with outwardly projecting teeth which are staggered along the length of the outer cutter and also shows the provision of a central solid bar.

It is also preferred to provide the short hair units with a low friction coating (e.g. Teflon) on the outer skin-engaging surfaces of the outer cutters to maximize movement between the skin and the outer cutters caused by the agitating element of the long hair unit.

Referring now to FIG. 30, this shows a isometric exploded view of a triple-headed shaver, having two short hair units 301, 302 and a long hair unit 303 centrally disposed between the short hair units. It differs from that shown for example in FIG. 14 or FIG. 22 primarily in the fact that it requires only two drive pins to cause oscillation of the undercutters of the short hair units. The long hair unit 303 in the form of a cartridge is driven in this embodiment by a drive member 3021 formed integrally with one of the short hair cutter units. Although this will not allow the variable phasing between the long hair unit and the short hair units possible with designs described earlier, it can be produced at lower cost.

FIG. 31 shows a simplified version of shaving apparatus according to an embodiment of the invention in which only two shaving units 311 and 312 are mounted on a housing 313, having a back half 3131 and a front half 3132 which carries a switch 314. Unit 311 is for shaving short hairs, while unit 312 is for shaving long hairs and may be constructed as shown in FIG. 8A. It is mounted on an intermediate frame member 315 sandwiched between the front and back housing halves 3131 and 3132 and is adjustable in position relative to the short hair unit 311 by movement of switch 314. The frame member 315 carries a pivotally mounted driver lever 316 in engagement with the coupling element 8 of the cartridge of FIG. 8A. The unit 311 is a substantially conventional short hair unit comprising an undercutter 3111 and a foil-type outer cutter 3112 which is inactive. As will be understood, the undercutter 3111 is driven in phase with the undercutter 6*a* of the unit 312 and thus in anti phase with the outer cutter 7*a* of unit 312.

FIG. 32 shows an isometric view of a further embodiment of active long hair cutter cartridge for implementing option 2, option 4 or option 7 of FIG. 2. The cartridge 320 comprises an outer cutter 321 mounted on two moveable carriers 322 and 331 by means of respective securing pins 323 and 324. The outer cutter assembly 321, 322 and 331 is movably mounted on a chassis assembly comprising a first end block 325, a second end block 326 and a pair of side plates 327 and 328, only one of which is visible in FIG. 32. First and second latches 329 and 330 are formed integrally with respective end blocks 325 and 326 for securing the cartridge into the shaver head.

FIG. 33 shows an isometric view of the cartridge of FIG. 32 with the outer cutter 321 and one side plate 327 of the chassis removed to expose the undercutter 332 mounted on a moveable carrier 333 from which extends a pair of coupling members 334 and 335. The moveable carriers 322 and 331 for the outer cutter are each connected to a respective linkage pivotably mounted on the chassis. Carrier 322 is mounted on an arm 336 pivotably connected to the side plates of the chassis at 337. Carrier 331 is coupled by means of a flexible linkage 338 to the carrier 333 for the undercutter 332. The linkage 338 is pivotably connected at 339 to the side plates of the chassis. The flexible linkage 338 will be described in more detail with reference to FIG. 35.

FIG. 34 shows the undercutter assembly with the undercutter itself removed to show more clearly the construction of the undercutter carrier 333.

Referring now to FIG. 35, the construction of the flexible linkage 338 will be described. The moveable carrier 331 is integrally connected via a first film hinge 351 to a double arm lever 352 which is integrally connected via a second film hinge 353 to a stabiliser 354 which in turn is integrally connected via a third film hinge 355 to a double arm lever or bell crank 356, which is pivotably connected at 339 to the side walls of the chassis. The double arm lever or bell crank 356 is integrally connected via a fourth film hinge 357 to a second stabiliser 358 which in turn is coupled by a fifth film hinge 359 to the carrier 333 for the undercutter.

It will be appreciated that when a drive source is coupled to the carrier 333 by means of a drive pin engaging between the coupling members 334 and 335, the carrier 333 is caused to reciprocate together with its undercutter 332. This movement is transmitted to the bell crank 356 which is caused to oscillate about the pivot 339. This oscillatory motion is then transmitted to the lever 352 and hence to the carrier 331 for the outer cutter 321. In this way, the outer cutter 321 is caused to reciprocate in anti-phase with the undercutter 332.

FIG. 36 shows an isometric view of a further embodiment of active long hair cutter cartridge, particularly suitable for implementing option 6 of FIG. 2. The cartridge 360 comprises an outer cutter 361 slidably mounted on an undercutter 362 which is mounted in the shaving head by means of respective latches 363 and 364. Being mounted in this way, the undercutter is static and only the outer cutter 361 moves. The left hand view (a) of FIG. 36 shows the outer cutter 361 in the central position on the undercutter 362. The right-hand view (b) of FIG. 36 shows the outer cutter 361 displaced fully to the left on the undercutter 362. In this embodiment, the outer cutter is pressed into contact with the undercutter 362 by means of a leaf spring 365. Extending downwardly from the centre of the outer cutter 361 are two coupling members 366 and 367 for receiving the drive pin of the motor therebetween to cause oscillatory motion of the outer cutter 361.

FIG. 37 shows the undercutter assembly 362 removed from engagement between the upper part of the outer cutter 361 and the leaf spring 365. As shown, the undercutter assembly comprises an undercutter member 360 secured to respective end blocks 371 and 372, from which the respective latches 363 and 364 extend.

FIG. 38 shows a further embodiment of active long hair cutter cartridge which is in effect a modification of the embodiment of FIGS. 36 and 37. The cartridge 380 again comprises a movable outer cutter assembly 381 and a static undercutter assembly 382. Again, a pair of coupling members 383 and 384 extend downwardly from the sidewalls of the outer cutter assembly 381. Here however the coupling members 383 and 384 are extended to respective ends of the outer cutter assembly 381 and engage between a pair of side members 385 and one end and 386 at the other end. Each coupling member extension provides a support pip for retaining a respective barrel spring 387 and 388 as emerges more clearly from FIG. 39.

In FIG. 39, the respective support pips 391 and 392 for the barrel springs 387 and 388 may be more clearly seen.

It will be appreciated that both in the embodiment of FIGS. 36 and 37 and in the embodiment of FIGS. 38 and 39 only at outer cutter assembly is caused to move by engagement with the drive pin from the motor. Since only the outer cutter moves, the drive linkage for the cartridge is considerably simpler than that required for the other active cartridges in which both the outer cutter and undercutter move. These embodiments may be used where simplicity and economy are primary considerations. In a very simple embodiment, only two shaving units are provided, one active and the other inactive. The active unit may be constructed according to FIGS. 36 and 37 or FIGS. 38 and 39. The undercutter of the inactive unit may then be directly coupled to the outer cutter of the active unit and driven in phase therewith in a very simple manner.

The invention has been described in connection with numerous embodiments, but further embodiments are possible and will occur to those skilled in the art. The scope of the invention extends to all such embodiments including those covered by the following claims. In the claims, the expressions "first", "second" and "third" are used to qualify various components. These expressions are simply convenient labels for identification purposes and have no further significance.

What is claimed is:

1. A dry shaver cartridge, comprising a support structure;

a first outer cutter constructed as a first of a pair of cooperating cutters of a first shaving unit configured as a short hair cutter;

an outer hair or skin engaging member and a movable second undercutter both mounted on the support structure for oscillatory motion, said outer hair or skin engaging member and movable second undercutter being spaced from said first outer cutter; and a linkage coupling the outer hair or skin engaging member to the movable second undercutter to constrain the outer hair or skin engaging member to be driven by motion of the undercutter.

2. The shaver cartridge of claim 1, wherein the outer hair or skin engaging member has a plurality of bars between which are defined a plurality of slits adapted for entry of hair.

3. The shaver cartridge of claim 2, wherein the slits extend over a lateral width of the outer hair or skin engaging member.

4. The shaver cartridge of claim 3, wherein the lateral slits define hair feeding channels extending through the lateral width.

5. The shaver cartridge of claim 1, wherein distal ends of the bars are disposed in a lateral width direction further outward than a lateral side of the movable second undercutter.

6. The shaver cartridge of claim 1, wherein the outer hair or skin engaging member has an upper surface which generally intersects a planar surface.

7. The shaver cartridge of claim 1, wherein the outer hair or skin engaging member is shaped like a comb.

8. The shaver cartridge of claim 7, wherein the comb-like outer hair or skin engaging member has a rib and a plurality of comb-like teeth extending along a single edge of the rib.

9. The shaver cartridge of claim 1, wherein the outer hair or skin engaging member has an outer surface adapted for enhanced grip on the skin.

10. The shaver cartridge of claim 9, wherein the outer surface is roughened.

11. The shaver cartridge of claim 9, wherein the outer surface is provided with a high-friction coating.

12. The shaver cartridge of claim 1, wherein the outer hair or skin engaging member has a low friction outer surface.

13. The shaver cartridge of claim 12, wherein the outer surface is provided with a low-friction coating.

14. The shaver cartridge of claim 1, wherein the outer hair or skin engaging member is made of metal.

15. The shaver cartridge of claim 1, wherein the outer hair or skin engaging member is configured as an outer cutter.

16. The shaver cartridge of claim 15, wherein the outer cutter and the movable second undercutter are configured as a long hair cutter.

17. The shaver cartridge of claim 1, wherein the outer hair or skin engaging member is mounted for linear reciprocation.

18. The shaver cartridge of claim 1, wherein the linkage is configured to drive the outer hair or skin engaging member in a second direction of motion transverse to a first longitudinal reciprocating motion.

19. The shaver cartridge of claim 18, wherein the second direction of motion is directed upward in a direction away from the movable second undercutter.

20. The shaver cartridge of claim 1, wherein the linkage comprises a crank member and an arm for movement of the outer hair or skin engaging member.

21. The shaver cartridge of claim 1, wherein the outer hair or skin engaging member is driven at a frequency which differs from that of said movable second undercutter.

22. The shaver cartridge of claim 1, wherein the outer hair or skin engaging member is coupled to the movable second undercutter to be oscillated in anti-phase with the movable second undercutter.

23. The shaver cartridge of claim 1, wherein the outer hair or skin engaging member is coupled to the movable second undercutter to be oscillated at 90° out of phase with the movable second undercutter.

24. The shaver cartridge of claim 1, wherein the outer hair or skin engaging member is coupled to the movable second undercutter to be oscillated in a manner such that it leads or lags the movable second undercutter by a phase angle in the range of 0° to 120°.

25. The dry shaver cartridge structure of claim 1 combination with a head housing, the combination defining a dry shaver head, the head housing having a chassis and a first undercutter mounted on the chassis in cooperating relationship with a first outer cutter mounted to the support structure and together forming a first shaving unit configured as a short hair cutter, and wherein the support structure is coupled to the chassis.

26. The dry shaver head combination of claim 25, wherein the support structure is releasably coupled to the chassis.

27. The dry shaver head combination of claim 25, wherein the head housing has pivots defining an axis for pivotal connection to a shaver housing containing a motor and a drive mechanism.

28. A dry shaver cartridge, comprising a support structure;

an outer hair or skin engaging member and a movable undercutter both mounted on the support structure for oscillatory motion, and a linkage coupling the outer hair or skin engaging member to the movable undercutter to constrain the outer hair or skin engaging member to be driven by motion of the undercutter.

* * * * *

UNITED STATES PATENT AND TRADEMARK OFFICE

CERTIFICATE OF CORRECTION

PATENT NO. : 6,615,492 B2
DATED : September 9, 2003
INVENTOR(S) : Parsonage et al.

It is certified that error appears in the above-identified patent and that said Letters Patent is hereby corrected as shown below:

Title page,
Item [*] Notice, delete the phrase "by 0" and insert -- by 159 days --

Signed and Sealed this

Third Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,615,492 B2
DATED : September 9, 2003
INVENTOR(S) : Terry Royle et al.

It is certified that error appears in the above-identified patent and that said Letters Patent is hereby corrected as shown below:

Column 15,
Line 52, delete “claim 1” and insert -- claim 2 --.

Column 16,
Line 43, insert -- in -- between “1” and “combination”.

Signed and Sealed this

Seventh Day of February, 2006

JON W. DUDAS
*Director of the United States Patent and Trademark Office*